US009669973B2

(12) United States Patent
Hoshino et al.

(10) Patent No.: US 9,669,973 B2
(45) Date of Patent: Jun. 6, 2017

(54) DOUBLE-WALLED CONTAINER

(71) Applicants: Shinya Hoshino, Tokyo (JP); Katsuhito Kuwahara, Tokyo (JP)

(72) Inventors: Shinya Hoshino, Tokyo (JP); Katsuhito Kuwahara, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 14/898,869

(22) PCT Filed: Jun. 26, 2014

(86) PCT No.: PCT/JP2014/003428
§ 371 (c)(1),
(2) Date: Dec. 16, 2015

(87) PCT Pub. No.: WO2014/208096
PCT Pub. Date: Dec. 31, 2014

(65) Prior Publication Data

US 2016/0145015 A1 May 26, 2016

(30) Foreign Application Priority Data

Jun. 28, 2013 (JP) ..... 2013-137349
Jun. 28, 2013 (JP) ..... 2013-137444
(Continued)

(51) Int. Cl.
*B65D 47/32* (2006.01)
*B65D 83/00* (2006.01)
(Continued)

(52) U.S. Cl.
CPC ..... *B65D 47/32* (2013.01); *B65D 1/0215* (2013.01); *B65D 47/0838* (2013.01);
(Continued)

(58) Field of Classification Search
CPC B65D 47/32; B65D 47/0838; B65D 47/2093; B65D 83/0055
(Continued)

(56) References Cited

U.S. PATENT DOCUMENTS 5,033,647 A * 7/1991 Smith ..... B05B 11/0072 222/212
5,366,115 A 11/1994 Kersten et al.
(Continued)

FOREIGN PATENT DOCUMENTS

JP H1045180 A 2/1998
JP 2003-191973 A 7/2003
(Continued)

OTHER PUBLICATIONS

Oct. 20, 2016 Office Action issued in Canadian Patent Application No. 2,916,039.
(Continued)

*Primary Examiner* — Donnell Long
(74) *Attorney, Agent, or Firm* — Oliff PLC

(57) ABSTRACT

Double container includes: inner layer body provided with upper opening; outer layer body accommodating inner layer body and including mouth portion provided with aperture; and dispensing cap provided with content dispensing spout and fitted to mouth portion. Double container further includes: inside plug provided with dispensing passage and fitted to upper opening; and check valve configured to open and close dispensing passage. Dispensing cap has a cylindrical wall, and cylindrical wall has a lower end portion fitted to an outer circumferential surface of outer layer body to provide vent region inside dispensing cap. Throttle passage is provided in a passage extending from ambient air introducing hole through vent region to aperture.

17 Claims, 12 Drawing Sheets

(30) Foreign Application Priority Data

Jun. 28, 2013 (JP) ..... 2013-137451
Mar. 31, 2014 (JP) ..... 2014-073947

(51) Int. Cl.
*B65D 47/08* (2006.01)
*B65D 47/20* (2006.01)
*B65D 1/02* (2006.01)

(52) U.S. Cl.
CPC ..... *B65D 47/2056* (2013.01); *B65D 47/2093* (2013.01); *B65D 83/0055* (2013.01)

(58) Field of Classification Search
USPC ..... 222/130, 131
See application file for complete search history.

(56) References Cited

U.S. PATENT DOCUMENTS 5,447,258 A 9/1995 Suzuki
6,708,850 B2 * 3/2004 Uetake ..... A61F 9/0008 222/105
2005/0040182 A1 2/2005 Suzuki

FOREIGN PATENT DOCUMENTS

JP 2006-069574 A 3/2006
JP 2006-206161 A 8/2006
JP 2006-232380 A 9/2006
JP 2011-031921 A 2/2011
JP 2011-073770 A 4/2011
JP 2011-230843 A 11/2011
JP 2013-014380 A 1/2013
JP 2013-071753 A 4/2013
JP 2013-071782 A 4/2013
TW 201309392 A1 3/2013
WO 2012/169489 A1 12/2012

OTHER PUBLICATIONS

Sep. 22, 2014 International Search Report issued in International Patent Application No. PCT/JP2014/003428.
Aug. 12, 2015 Office Action issued in Taiwanese Patent Application No. 103122305.
Jul. 27, 2016 Chinese Office Action issued in Patent Application No. 201480034659.7.
Jun. 29, 2016 Australian Office Action issued in Patent Application No. 2014300355.
Jan. 26, 2017 Search Report issued in European Patent Application No. 14818472.4.
Jan. 12, 2017 Office Action issued in Chinese Patent Application No. 201480034659.7.
Dec. 13, 2016 Office Action issued in Korean Patent Application No. 10-2015-7035655.
Mar. 28, 2017 Office Action issued in Japanese Patent Application No. 2013-247597.

* cited by examiner

DOUBLE-WALLED CONTAINER

TECHNICAL FIELD

This disclosure relates to a double-walled container (hereinafter, called double container) having a double-layered structure with an inner layer body and an outer layer body. The inner layer body is configured to contain a content and accommodated in the outer layer body. At the time of dispensing the content, only the inner layer body is allowed to shrink.

BACKGROUND

As a container for containing, for example, shampoo, rinse, liquid soap, cosmetics such as face lotion, and food seasoning such as cooking rice wine, sweet cooking rice wine, soy sauce, and other sauces, a double container (delamination container) is conventionally known to have a double-walled structure with an inner layer body and an outer layer body. The inner layer body is configured to contain a content and accommodated in the outer layer body, and the outer layer body has a mouth portion equipped with a dispensing cap having a dispensing spout from which the content is dispensed. A double container may cause, at the time of dispensing the content, ambient air to be introduced between the inner layer body and the outer layer body through an aperture provided in the outer layer body to thereby shrink the inner layer body. This arrangement may prevent ambient air from flowing into the inner layer body after dispensing and minimize the contact of the content with ambient air accordingly.

In such a double container, a check valve is provided in a passage extending between an ambient air introducing hole provided in the dispensing cap and an aperture in the outer layer body. The check valve is configured to hold ambient air between the inner layer body and the outer layer body that was introduced therebetween at the time of dispensing the content, so that the content can be dispensed when the outer layer body is squeezed.

For example, JP2011031921A (PTL 1) describes a double container comprising: a dispensing cap having a vent region defined inside the dispensing cap and isolated from the outside, the vent region placing an aperture provided in a mouth portion of an outer layer body in communication with an ambient air introducing hole provided in the dispensing cap; and a check valve arranged inside the dispensing cap and configured to open and close the ambient air introducing hole.

CITATION LIST

Patent Literature

PTL 1: JP2011031921A

SUMMARY

Technical Problem

However, the double container set forth in PTL 1 has the problem of high production cost due to the use of a check valve for holding ambient air introduced between the inner layer body and the outer layer body, leading to an increase in the number of parts of the product.

To solve the above problem, it could thus be helpful to provide a low-cost a double container for which no check valve is required for holding ambient air introduced between the inner layer body and the outer layer body.

Solution to Problem

In one aspect, one of embodiments of the present disclosure resides in a double container, comprising: an inner layer body provided with an upper opening contiguous with a content container portion; an outer layer body accommodating the inner layer body and including a mouth portion provided with an aperture, through which aperture ambient air is introduced between the inner layer body and the outer layer body; and a dispensing cap provided with a content dispensing spout and fitted to the mouth portion of the outer layer body, wherein the double container further includes: an inside plug provided with a dispensing passage and fitted to the upper opening, the dispensing passage placing the container portion in communication with the dispensing spout; and a check valve configured to open and close the dispensing passage, a vent region is provided inside the dispensing cap, and a throttle passage is provided in a passage extending from an ambient air introducing hole through the vent region to the aperture, the ambient air introducing hole placing the vent region in communication with the outside.

In another aspect, according to a preferred embodiment, the ambient air introducing hole is provided in the dispensing cap, the dispensing cap includes a cylindrical wall covering the outer circumference of the mouth portion, and the cylindrical wall includes a lower end portion fitted to an outer circumferential surface of the outer layer body to seal a lower end of the vent region, between the dispensing cap and the inside plug, a partition wall is provided to divide the interior of the dispensing cap into the vent region and a dispensing region connecting the dispensing passage and the dispensing spout, and the throttle passage is provided above the upper opening.

According to another preferred embodiment, the throttle passage is provided in the dispensing cap together with the ambient air introducing hole.

According to still another preferred embodiment, the throttle passage is provided in the inside plug.

According to yet another preferred embodiment, the throttle passage is a space between the dispensing cap and the inside plug.

In still another aspect, according to a preferred embodiment, the inside plug has the dispensing passage in a ceiling wall covering the upper opening, and includes an inner circumferential wall standing from an edge of the ceiling wall, the dispensing cap includes a cylindrical wall that is engaged with and held by the mouth portion and that forms a vent passage in communication with the aperture between the mouth portion and an inner circumferential wall of the inside plug, and the dispensing spout and the ambient air introducing hole are provided in a top wall connecting to the cylindrical wall, the check valve includes a partition wall that is provided between the dispensing spout and the ambient air introducing hole and that extends between the ceiling wall and the top wall so as to define, with the inner circumferential wall, an inner space connecting to the ambient air introducing hole, the inside plug has a connection passage connecting the inner space and the vent passage between an upper surface of the inner circumferential wall and a lower surface of the top wall, and the throttle passage is provided in at least one of the vent passage and the connection passage.

According to another preferred embodiment, the throttle passage is a narrow groove provided on at least one of an outer circumferential surface of the inner circumferential wall and an inner circumferential surface of the cylindrical wall.

According to still another preferred embodiment, the throttle passage is a narrow groove provided on at least one of an upper surface of the inner circumferential wall and a lower surface of the top wall.

According to yet another preferred embodiment, one of the inner circumferential wall and the outer circumferential wall has a helical convex portion protruding toward the other.

According to a further preferred embodiment, the dispensing cap has a projection protruding from a lower surface of the top wall between the ambient air introducing hole and the inner circumferential wall.

According to a still further preferred embodiment, the inside plug has a tubular wall that extends toward the container portion, and a spherical body that is displaceable inside the tubular wall in response to a change in position of the outer layer body.

In yet another aspect, according to a preferred embodiment, the dispensing cap includes a cylindrical wall covering the outer circumference of the mouth portion, and the cylindrical wall includes a lower end portion fitted to an outer circumferential surface of the outer layer body to define a vent region formed between the cylindrical wall and the mouth portion, and the throttle passage is provided below the upper opening.

According to another preferred embodiment, the throttle passage is formed in a groove-like manner on an inner circumferential surface of the cylindrical wall in a lower end portion thereof.

According to still another preferred embodiment, the throttle passage is provided in the cylindrical wall.

In a further aspect, according to a preferred embodiment, the check valve has a partition wall to separate the dispensing spout from the ambient air introducing hole to form at least one said vent region inside the dispensing cap, and the sum of the minimum cross-sectional area of each vent region is 0.11 $mm^2$ to 0.19 $mm^2$.

According to another preferred embodiment, a groove portion forming part of the vent region and having the minimum cross-sectional area in the vent region is provided on at least one of the cylindrical wall and the periphery of the inside plug.

According to still another preferred embodiment, the groove portion is provided on the periphery of the inside plug.

Advantageous Effect

According to the disclosure, providing the throttle passage in the passage extending from the ambient air introducing hole through the vent region to the aperture of the outer layer body enables ambient air introduced into the vent region through the ambient air introducing hole at the time of dispensing the content to be introduced between the inner layer body and the outer layer body through the aperture, and the air held between the inner layer body and the outer layer body can be maintained at desired pressure so that the content can be dispensed when the outer layer body is squeezed. This arrangement eliminates the need for a check valve and can reduce the cost of the double container.

DETAILED DESCRIPTION

Some embodiments of the present disclosure will be described in more detail below with reference to the drawings.

Throughout this disclosure, the term "upper" is used to refer to the side on which the dispensing cap is located relative to the outer layer body when the double container is placed on a horizontal plane.

Figure 1:
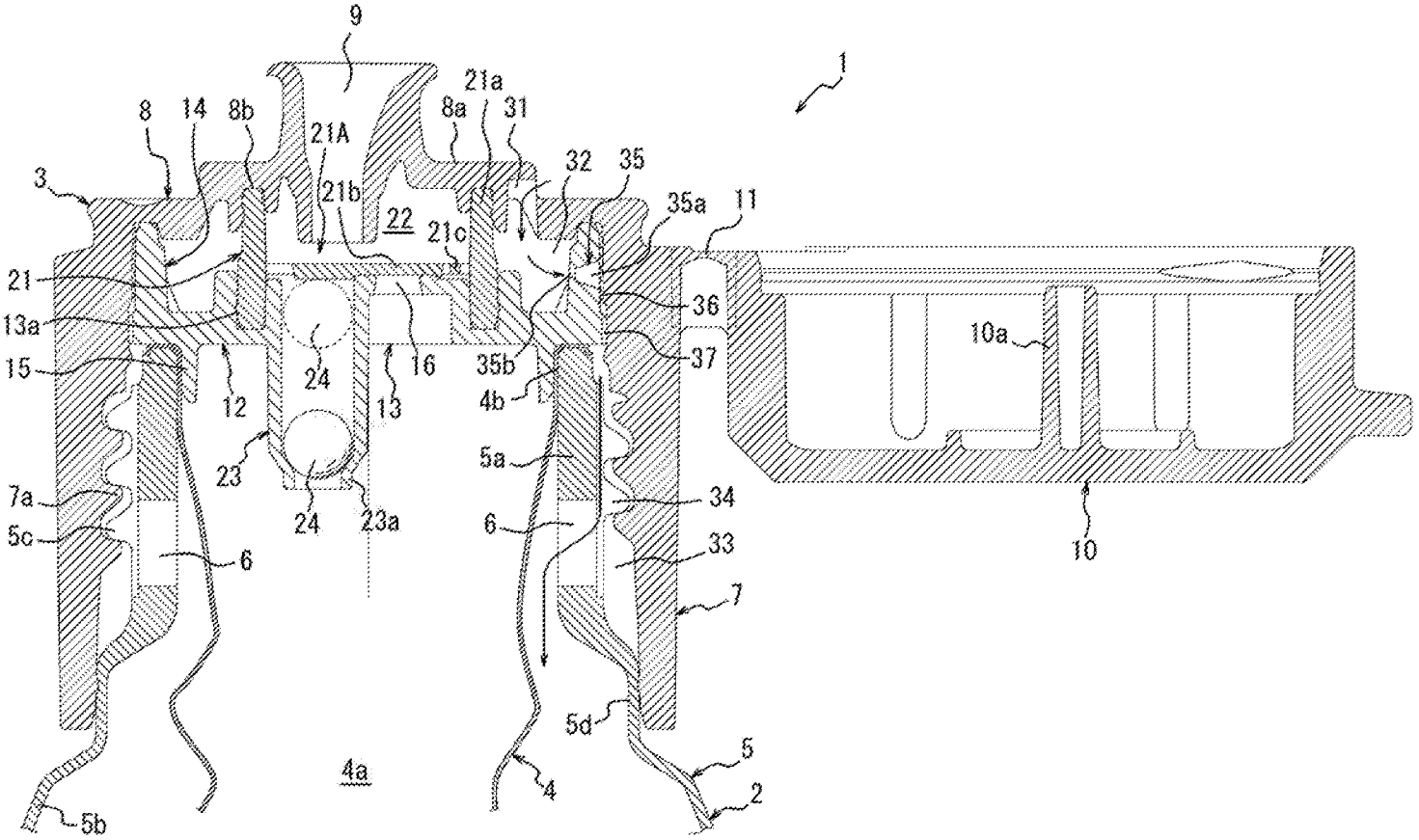
FIG. 1 is a sectional view of a part of a double container according to a first embodiment of the disclosure.

FIG. 1 illustrates a double container 1 according to a first embodiment of the disclosure. The double container 1 is configured to contain, for example, a liquid content such as food seasoning, and has a container body 2 and a dispensing cap 3. The container body 2 has a double-walled structure of peelable laminated type, including an inner layer body 4 and an outer layer body 5. The dispensing cap 3 is mounted on a mouth portion 5*a* that is provided in the outer layer body 5. The container body 2 is not limited to the peelable laminated type, and may be of the assembled type such that the inner layer body (inner container) 4 and the outer layer body (outer container) 5 are formed separately and assembled together.

The inner layer body 4 constituting the container body 2 is formed into a flexible bag body made of thin synthetic resin, for example, and has inside thereof a container portion 4*a* for containing a content. The inner layer body 4 has in its upper end portion an upper opening 4*b* contiguous with the container portion 4*a*. The content contained in the container portion 4*a* can be dispensed from the upper opening 4*b*.

The outer layer body 5 forms an outer shell of the container body 2, and has the mouth portion 5*a* and a trunk portion 5*b* that is integrally connected to the mouth portion 5*a*. The outer layer body 5 accommodates the inner layer body 4 in a manner such that the inner layer body is peelable from the outer layer body. The mouth portion 5*a* of the outer layer body 5 includes an opening edge to which the upper opening 4*b* of the inner layer body 4 is fixed.

The mouth portion 5*a* of the outer layer body 5 has a cylindrical shape, and includes an outer circumferential surface that is integrally provided with a male screw portion 5*c*. A pair of apertures 6, each extending through the mouth portion 5*a* along a radial direction, are also provided in the mouth portion 5*a* of the outer layer body 5. These apertures 6 communicate between the inner layer body 4 and the outer layer body 5, and therefore, ambient air can be introduced between the inner layer body 4 and the outer layer body 5 through the apertures 6. The number of apertures is not so limited, and it suffices to provide at least one aperture 6.

The dispensing cap 3 has a topped cylindrical shape including a cylindrical wall 7 and a top wall 8 that is contiguous with the upper end of the cylindrical wall 7. The cylindrical wall 7 includes an inner circumferential surface that is integrally provided with a female screw portion 7*a*. The dispensing cap 3 is mounted on the mouth portion 5*a* of the outer layer body 5 with the female screw portion 7*a* being screwed to a male screw portion 5*c* that is provided in the mouth portion 5*a* of the outer layer body 5. When the dispensing cap 3 is mounted on the mouth portion 5*a*, the cylindrical wall 7 covers the outer circumference of the mouth portion 5*a* and the top wall 8 covers over the mouth portion 5*a*. On the top wall 8 of the dispensing cap 3, a cylindrical stepped portion 8*a* protruding upward is provided. The stepped portion 8*a* is integrally provided with a dispensing spout (nozzle) 9 that is axially offset from the top wall 8. The dispensing spout 9 protrudes in a flared form from the upper surface of the stepped portion 8*a* in the top wall 8, while protruding in a cylindrical form from the lower surface of the stepped portion 8*a* and extending through the top wall 8. The dispensing spout 9 communicates with the upper opening 4*b* of the inner layer body 4 so that the content contained in the inner layer body 4 can be dispensed to the outside. As used herein, the term "above" is used to refer to the side on which the upper opening 4*b* is provided relative to the container portion 4*a* of the inner layer body 4.

The dispensing cap 3 is provided with an over cap 10 that is openable and closable about a hinge 11. The over cap 10 has a topped cylindrical shape that is substantially the same in diameter as the dispensing cap 3, and can engage with the dispensing cap 3 by means of an undercut or the like to hold the dispensing cap 3 in a closed position. The over cap 10 includes an inner surface with which a cylindrical plug body 10*a* is integrally formed and from which the cylindrical plug body 10*a* protrudes. When the over cap 10 is closed, the cylindrical plug body 10*a* is fitted into the dispensing spout 9 so that the dispensing spout is blocked by the cylindrical plug body.

An inside plug 12 is mounted on the upper opening 4*b* of the inner layer body 4. The inside plug 12, which is made of, for example, synthetic resin, is provided with a substantially disk-shaped main body portion 13 and a cylindrical inner circumferential wall (spacer portion) 14 that protrudes upward from an outer circumferential edge of the main body portion 13. The inner circumferential wall 14 has an outer diameter that is substantially the same as the inner diameter of the cylindrical wall 7 of the dispensing cap 3. The inside plug 12 is located inside the dispensing cap 3, with an outer circumferential surface of the inner circumferential wall 14 being fitted to the inner circumferential surface of the cylindrical wall 7 and the upper end of the inner circumferential wall 14 being abutted against the top wall 8 in an axial direction. By providing the inner circumferential wall 14, space is formed between the inside plug 12 mounted on the dispensing cap 3 and the top wall 8 of the dispensing cap 3. The main body portion 13 of the inside plug 12 includes a lower surface, i.e., a surface facing the container portion 4*a* side of the inner layer body 4, which is coaxially and integrally formed with a cylindrical fitting tubular portion 15. The fitting tubular portion 15 is fitted into the mouth portion 5*a* in a liquid tight manner. Additionally, the main body portion 13 of the inside plug 12 is provided with a dispensing passage 16 that is formed as a through hole extending through the main body portion 13. The dispensing passage 16 places the container portion 4*a* of the inner layer body 4 in communication with the dispensing spout 9 of the dispensing cap 3.

A valve unit 21 that is made of, for example, synthetic resin, rubber, elastomer, or silicon is mounted in the space between the dispensing cap 3 and the inside plug 12. The valve unit 21 has a cylindrical partition wall 21*a*. The partition wall 21*a* has one axial end fitted into an annular groove 13*a* that is formed on the upper surface of the main body portion 13 of the inside plug 12, and the other axial end fitted into an annular groove 8*b* that is formed coaxially with the annular groove 13*a* on the lower surface of the top wall 8 of the dispensing cap 3. This configuration fixes the partition wall 21*a* between the dispensing cap 3 and the inside plug 12. The interior space of the dispensing cap 3 defined by the partition wall 21*a* is a dispensing region 22 that connects the dispensing passage 16 and the dispensing spout 9. The content dispensed from the dispensing passage 16 is caused to flow through the dispensing region 22 to the dispensing spout 9.

The partition wall 21*a* is integrally provided with a check valve 21A that is located radially inward of the partition wall 21*a* to prevent ambient air from being introduced from the dispensing passage 16 into the container portion 4*a* of the inner layer body 4. The check valve 21A has a disk-shaped valve body 21*b* that is coaxial with the partition wall 21*a*. The valve body 21*b* is connected at its outer circumferential edge to the inner circumferential surface of the partition wall 21*a* by a plurality of (e.g., three) elastically deformable connecting pieces 21*c*, and is displaceable in an axial direction thereof (in the vertical direction), relative to the partition wall 21*a*, in response to the elastic deformation of these connecting pieces 21*c*. The valve body 21*b* is located on an opening edge of the dispensing passage 16 facing the dispensing spout 9 side to block the dispensing passage 16. When pressure is applied to the content contained in the inner layer body 4 upon, for example, the outer layer body 5 being squeezed, the valve body 21*b* opens and the content is caused to circulate from the dispensing passage 16 toward the dispensing spout 9. On the other hand, upon the content being released from the pressure after dispensing of the content, the valve body 21*b* is returned to the position by elastic force of the connecting pieces 21*c* to block the dispensing passage 16. This arrangement prevents ambient air from flowing through the dispensing passage 16 into the container portion 4*a* of the inner layer body 4.

The main body portion 13 of the inside plug 12 is integrally formed with a cylindrical tubular portion 23 that is adjacent to the dispensing passage 16. The tubular portion 23 opens to the container portion 4*a* of the inner layer body 4 and to the dispensing region 22 of the dispensing cap 3. A ball 24 having a spherical shape, which is made of steel material, resin material, or the like, is located inside the tubular portion 23. The ball 24 has a diameter substantially the same as the inner diameter of the tubular portion 23, and is displaceable in an axial direction inside the tubular portion 23. The tubular portion 23 includes a lower end that is integrally provided with a diameter-decreasing portion 23*a*, and an upper end on which the valve body 21*b* is partially located. Consequently, the ball 24 is held inside the tubular portion 23. The ball 24 is positioned by its own weight at one end of the tubular portion 23 on the container portion 4*a* side when the double container 1 is in an upright position with the dispensing cap 3 on top. Alternatively, when the content is dispensed from the double container 1 at an inclination of 90° or more with respect to the upright position, the ball 24 is displaced to the other end of the tubular portion 23 on the dispensing region 22 side, as indicated by dashed line in the figure. When the double container 1 is returned to the upright position subsequent to the dispensing of the content in the above state, the ball 24 is displaced inside the tubular portion 23 away from the dispensing region 22 and toward the container portion 4*a* side, and as a consequence, any content left in the dispensing spout 9, the dispensing region 22, or the like will be drawn (or sucked back) into the tubular portion 23. This arrangement can effectively prevent dripping of the content from the tip of the dispensing spout 9.

To cause ambient air to be introduced to the apertures 6 provided in the mouth portion 5*a* of the outer layer body 5, the dispensing cap 3 is provided with an ambient air introducing hole 31. In the depicted embodiment, the ambient air introducing hole 31 is provided in the top wall 8 of the dispensing cap 3. The space located outside the partition wall 21*a* between the top wall 8 of the dispensing cap 3 and the inside plug 12 is a first vent region 32. The ambient air introducing hole 31 communicates with the first vent region 32, and opens at a side of the stepped portion 8*a* to the outside of the dispensing cap 3.

On the other hand, the space between the cylindrical wall 7 of the dispensing cap 3 and the mouth portion 5*a* of the outer layer body 5 is a second vent region 33. The apertures 6 provided in the mouth portion 5*a* of the outer layer body 5 open to the second vent region 33. The male screw portion 5*c* provided in the mouth portion 5*a* is provided with a slit-like groove portion 34 that extends along an axial direction. The groove portion 34 also forms part of the second vent region 33. Between the mouth portion 5*a* of the outer layer body 5 and the trunk portion 5*b*, a cylindrical fitting portion 5*d* that is larger in diameter than the mouth portion 5*a* is integrally provided.

The fitting portion 5*d* includes an outer circumferential surface against which a lower end portion of the cylindrical wall 7 of the dispensing cap 3 is abutted to seal a lower end of the second vent region 33.

In the inner circumferential wall 14 of the inside plug 12, a throttle passage 35 is provided above the upper opening 4*b* of the inner layer body 4 (on the side of the upper opening 4*b* opposite to the container portion 4*a*). The throttle passage 35 has a diameter-increasing hole 35*a* with a tapered inner surface and a small hole 35*b* with a constant inner diameter that is provided in the bottom wall of the diameter-increasing hole 35*a*. The small hole 35*b* in the throttle passage 35 opens to the first vent region 32. The diameter-increasing hole 35*a* in the throttle passage 35 opens to a helical passage 36 that is formed between the outer circumferential surface of the inner circumferential wall 14 and the inner circumferential surface of the cylindrical wall 7. At the lower end of the outer circumferential surface of the inner circumferential wall 14, a communication groove 37 that extends in an axial direction is formed. The communication groove 37 places the helical passage 36 in communication with the second vent region 33. In other words, the first vent region 32 and the second vent region 33 communicate with each other via the throttle passage 35. The small hole 35*b* of the throttle passage 35 serves as an orifice, which may create a predetermined resistance to ambient air (air) flowing between the first vent region 32 and the second vent region 33.

The above configuration produces a passage inside the dispensing cap 3 for causing ambient air to be introduced from the ambient air introducing hole 31 via the first vent region 32 through the throttle passage 35 over the second vent region 33 to the apertures 6. Accordingly, when the inner layer body 4 is reduced in volume as the content is dispensed, ambient air can be introduced from the ambient air introducing hole 31 via the passage to the apertures 6, i.e., between the inner layer body 4 and the outer layer body 5.

On the other hand, when the outer layer body 5 is squeezed for dispensing the content, air left between the inner layer body 4 and the outer layer body 5 tries to escape, due to an increase in pressure of the air, from the apertures 6 toward the ambient air introducing hole 31. However, since the throttle passage 35 is provided in the vent passage between the apertures 6 and the ambient air introducing hole 31, even when the pressure of air held between the inner layer body 4 and the outer layer body 5 increases in response to the squeezing of the outer layer body 5, there is a considerable resistance to the passage of such air through the throttle passage 35, preventing the air from easily flowing toward the ambient air introducing hole 31. In other words, the pressure of air held between the inner layer body 4 and the outer layer body 5 that has increased in response to the squeezing of the outer layer body 5 will drop gradually, not rapidly. Accordingly, when the outer layer body 5 is squeezed for dispensing the content, the pressure of air held between the inner layer body 4 and the outer layer body 5 can be maintained high enough for a while for the content to be dispensed from the inner layer body 4. This arrangement enables the inner layer body 4 to be compressed by the pressurized air held between the inner layer body 4 and the outer layer body 5 in response to the squeezing of the outer layer body 5, so that the content contained in the container portion 4*a* of the inner layer body 4 is caused to be dispensed from the dispensing spout 9 of the dispensing cap 3 to the outside.

To achieve the above functionality, the inner diameter of the small hole 35*b* of the throttle passage 35 is set based on the amount of the content to be dispensed, the rigidity of the outer layer body 5, the restoring force after squeezing, and the like so that the content can be dispensed in response to the squeezing of the outer layer body 5.

In this way, by providing inside the dispensing cap 3 a passage for ventilation extending from the ambient air introducing hole 31 via the first vent region 32 and the second vent region 33 to the apertures 6, and by providing the throttle passage 35 in this passage, it becomes possible, at the time of dispensing the content, to cause ambient air to be introduced from the ambient air introducing hole 31 through the passage to the apertures 6, i.e., between the inner layer body 4 and the outer layer body 5 and, upon the outer layer body 5 being squeezed for dispensing the content, to maintain the air held between the inner layer body 4 and the outer layer body 5 at high pressure so that the content contained in the inner layer body 4 can be dispensed from the dispensing spout 9 of the dispensing cap 3 to the outside. Moreover, the throttle passage 35 is integrally provided with the inside plug 12, which fact eliminates the need for additional parts such as a check valve, and thus may reduce the number of parts required for the double container 1, thereby reducing the cost of the double container.

In the embodiment illustrated in FIG. 1, the ambient air introducing hole 31 is shown to be provided in the top wall 8 of the dispensing cap 3 and the throttle passage 35 to be provided in the inner circumferential wall 14 of the inside plug 12. However, in the case where the ambient air introducing hole 31 is provided in the dispensing cap 3 and the throttle passage 35 is provided above the upper opening 4*b* of the inner layer body 4, many modifications to the depicted arrangement may be made as is the case with variations depicted in FIGS. 2 to 6. In FIGS. 2 to 6, members corresponding to those described above are denoted by the same reference numerals.

Figure 2:
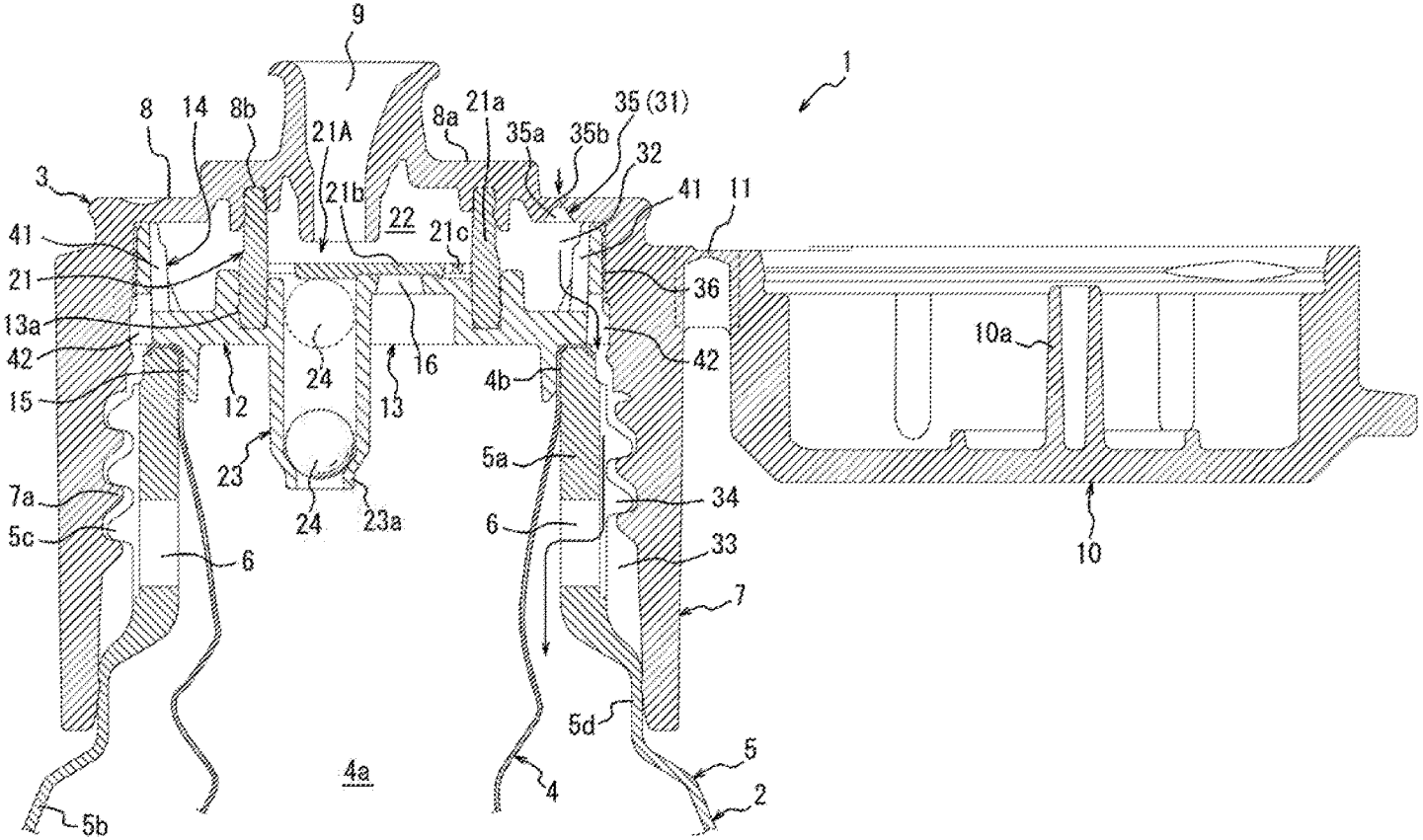
FIG. 2 is a sectional view of a variation of the double container in FIG. 1, where a throttle passage is provided in the top wall of the dispensing cap together with the ambient air introducing hole.

For example, in a variation depicted in FIG. 2, the throttle passage 35 is provided in the top wall 8 of the dispensing cap 3. In this case, the throttle passage 35 also serves as the ambient air introducing hole 31, and may cause ambient air to be introduced to the first vent region 32 that is located inside the dispensing cap 3, while causing the air in the first vent region 32 to be discharged to the outside. In the above configuration the throttle passage 35 also serves as the ambient air introducing hole 31, which can simplify the structure of the double container 1, resulting in a further reduction in the cost of the double container.

In this case, the throttle passage 35 may also be configured to have the diameter-increasing hole 35*a* with a tapered inner surface that opens to the fist vent region 32, and the small hole 35*b* with a constant inner diameter that is provided in the bottom wall of the diameter-increasing hole 35*a* and that opens to the outside. Additionally, to place the first vent region 32 in communication with the second vent region 33, the inner circumferential wall 14 of the inside plug 12 may be configured to have in its inner circumferential surface the longitudinal groove 41 that extends in an axial direction, and in its outer circumferential surface the cut-out portion 42 that communicates with the longitudinal groove 41.

Figure 3:
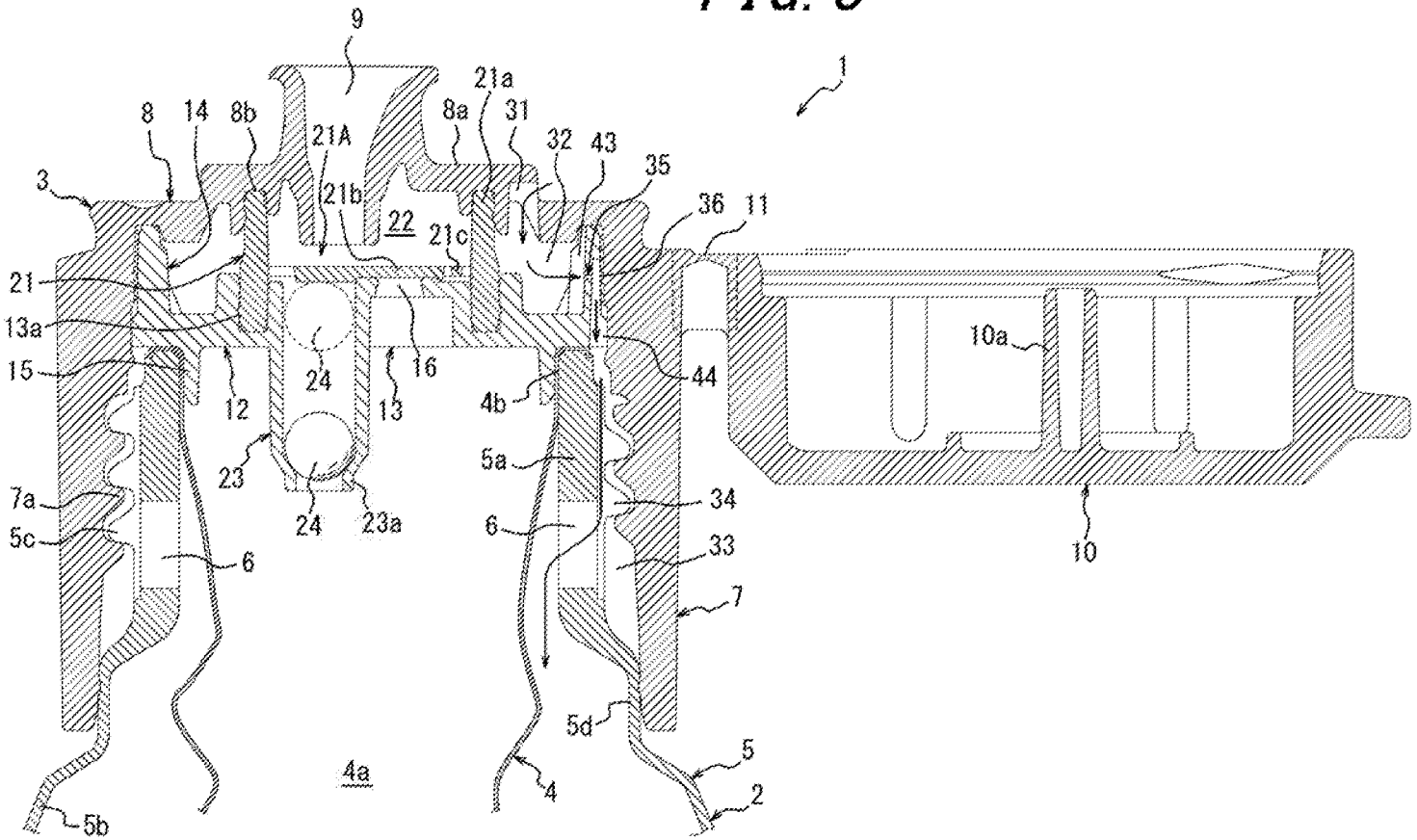
FIG. 3 is a sectional view of a variation of the double container in FIG. 1, where the throttle passage provided in the inside plug is placed in communication with a second vent region through a longitudinal groove provided on an outer circumferential surface of the inside plug.

In a variation depicted in FIG. 3, the inner circumferential wall 14 of the inside plug 12 includes an inner circumferential surface and an outer circumferential surface in which longitudinal grooves 43, 44 are provided, respectively. The throttle passage 35 is provided in a thin cylindrical plate portion sandwiched between the longitudinal grooves 43, 44. In this case, the throttle passage 35 takes the form of a small hole with a constant inner diameter, and is placed in communication with the first vent region 32 via a longitudinal groove 43 that is provided in the inner circumferential surface of the inside plug 12, and with the second vent region 33 via the longitudinal groove 44 that is provided in the outer circumferential surface of the inside plug 12.

Figure 4:
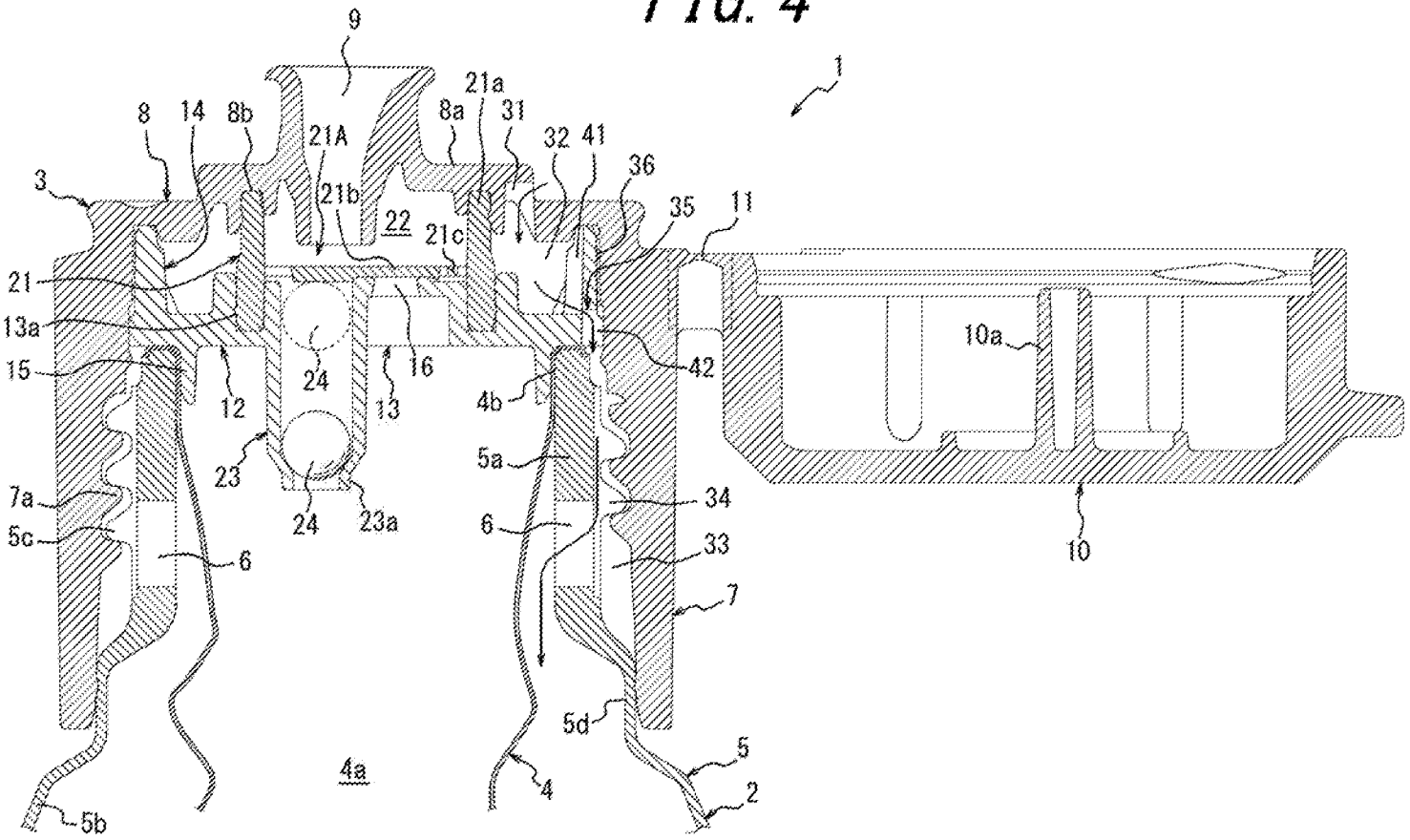
FIG. 4 is a sectional view of a variation of the double container in FIG. 1, where a slit-like throttle passage is provided in the inside plug.

In a variation depicted in FIG. 4, the longitudinal groove 41, which is provided in the inner circumferential surface of the inner circumferential wall 14 of the inside plug 12 and which extends in an axial direction, and the cut-out portion 42, which is provided in the outer circumferential surface of the inner circumferential wall 14, are placed in communication with each other over a limited range, or through a slit-like communication portion between them. This slit-like communication portion provides the throttle passage 35.

Figure 5:
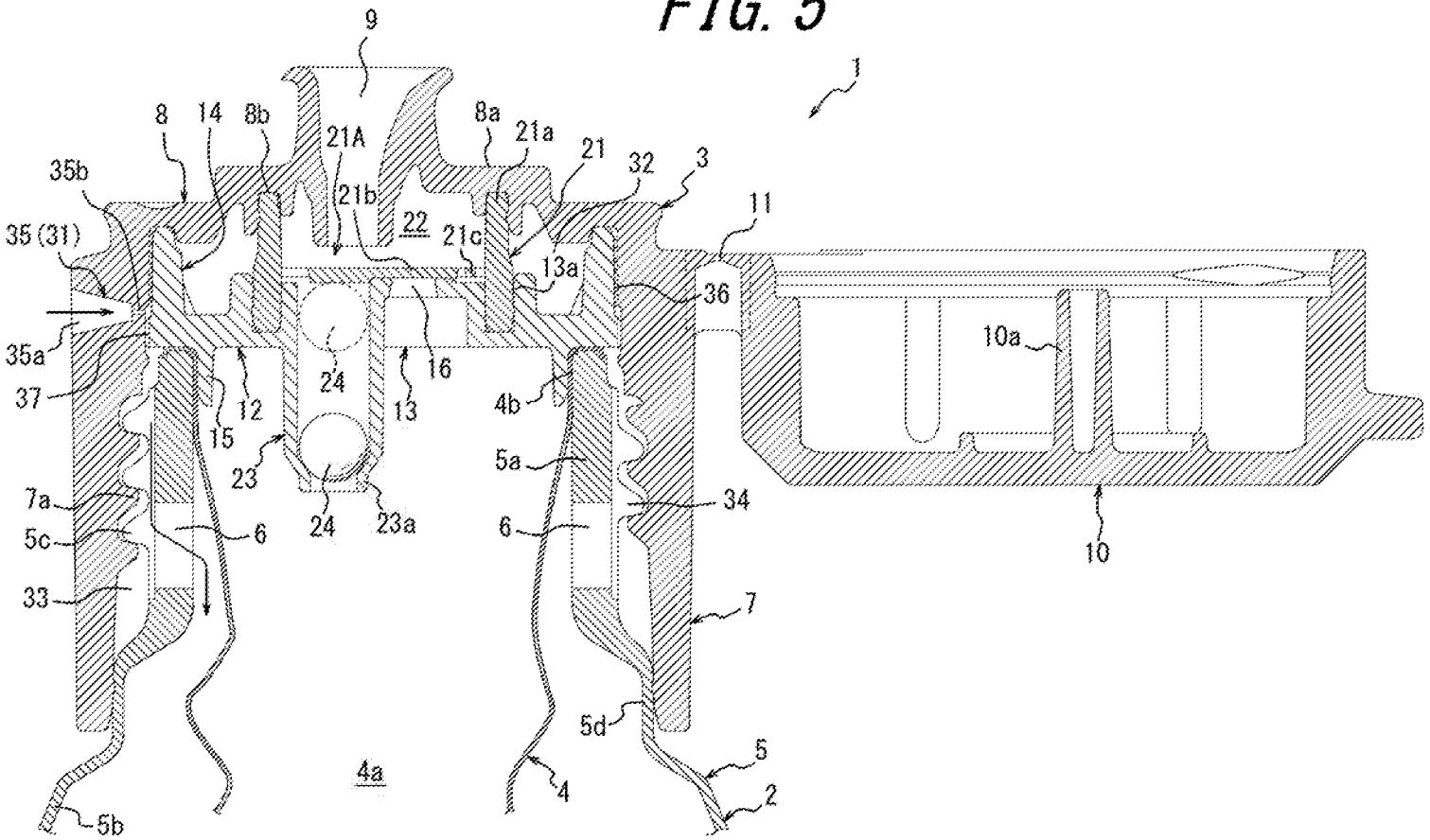
FIG. 5 is a sectional view of a variation of the double container in FIG. 1, where a throttle passage is provided in the cylindrical wall of the dispensing cap together with the ambient air introducing hole.

In a variation depicted in FIG. 5, the throttle passage 35 is provided in the cylindrical wall 7 of the dispensing cap 3. In this case, the throttle passage 35 is provided above the upper opening 4*b* of the inner layer body 4, and is placed in communication with the second vent region 33 via the communication groove 37 that is provided in the outer circumferential surface of the inner circumferential wall 14. In this variation, vent region may be configured with the second vent region 33 alone.

Additionally, in the variation in FIG. 5, the throttle passage 35 also serves as the ambient air introducing hole 31, and may cause ambient air to be introduced to the second vent region 33 that is located inside the dispensing cap 3, while causing the air in the second vent region 33 to be discharged to the outside. This arrangement may simplify the structure of the double container 1, resulting in a further reduction in the cost of the double container.

In this case, similar to the variations in FIGS. 1 and 2, the throttle passage 35 may also be configured to have the diameter-increasing hole 35*a* and the small hole 35*b*.

Figure 6:
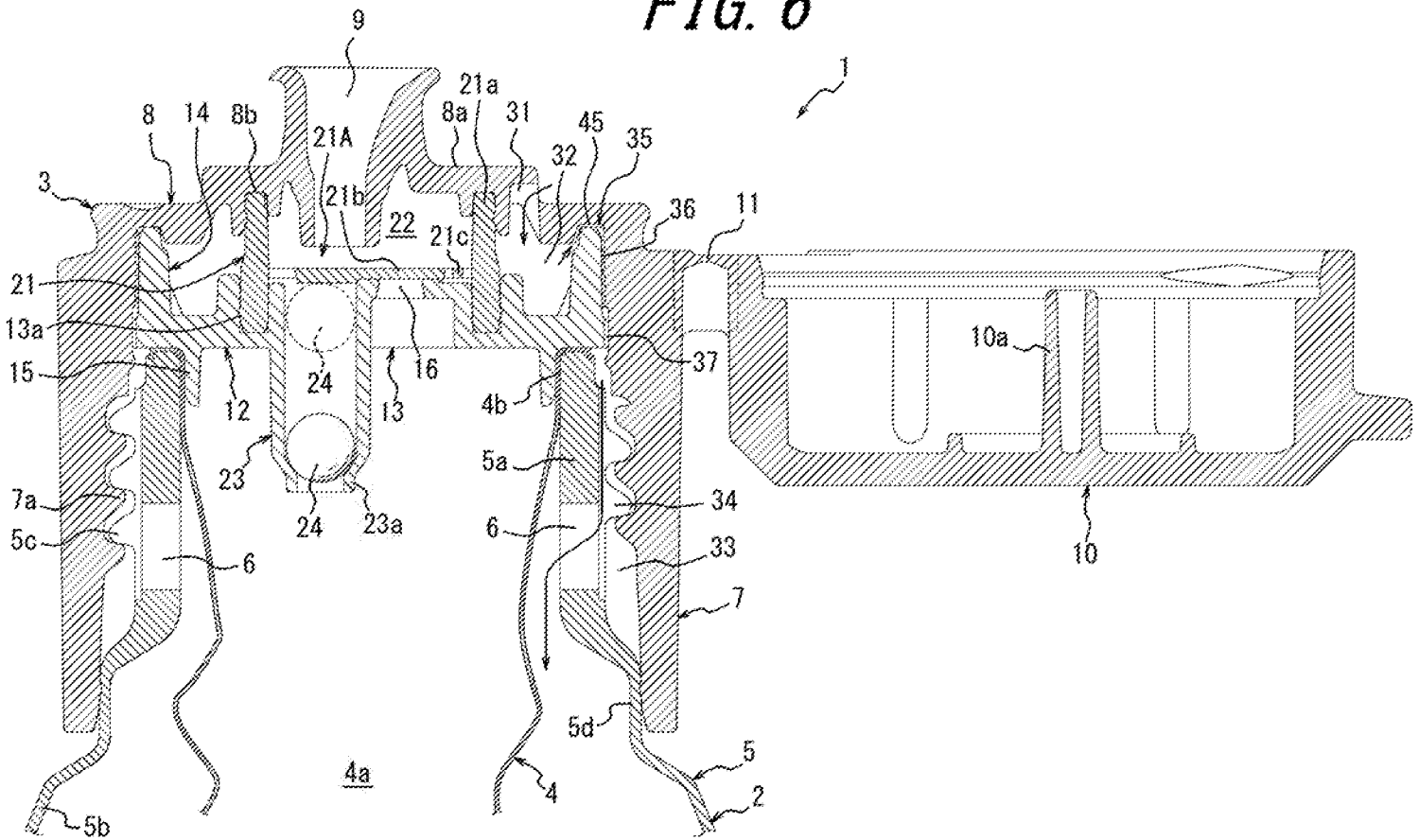
FIG. 6 is a sectional view of a variation of the double container in FIG. 1, where the throttle passage is a space between the dispensing cap and the inside plug.

In a variation depicted in FIG. 6, the throttle passage 35 is a gap formed between the dispensing cap 3 and the inside plug 12. In the depicted embodiment, the top wall 8 of the dispensing cap 3 includes an inner surface in which a throttle groove 45 extending in a radial direction is formed. The throttle groove 45 includes an opening that is blocked by the upper end of the inner circumferential wall 14 of the inside plug 12. The throttle groove 45 also forms a gap between the dispensing cap 3 and the inside plug 12, which serves as the throttle passage 35. The throttle passage 35 has one end that is in direct communication with the first vent region 32, and the other end that is placed in communication with the second vent region 33 via the helical passage 36 and the communication groove 37.

In the depicted embodiment, the inner surface of the top wall 8 of the dispensing cap 3 has the throttle groove 45 provided therein and the throttle passage 35 is formed between the dispensing cap 3 and the inside plug 12. In another possible configuration, however, the throttle groove 45 may be provided in the tip surface of the inner circumferential wall 14 that is abutted against the dispensing cap 3 and the throttle passage 35 may be formed between the dispensing cap 3 and the inside plug 12. Alternatively, throttle grooves 45 may be provided in the inner surface of the top wall 8 of the dispensing cap 3 and in the tip surface of the inner circumferential wall 14 that is abutted against the dispensing cap 3, respectively, and the throttle passage 35 may be formed between the dispensing cap 3 and the inside plug 12.

In the above first embodiment, in order to enable the content to be dispensed in response to the squeezing of the outer layer body 5, the inner diameter of the throttle passage 35 is adjusted based on the amount of the content to be dispensed, the rigidity of the outer layer body 5, the restoring force after squeezing, and the like so that the. However, the resistance to be applied against ambient air (air) flowing through the vent passage between the ambient air introducing hole 31 and the apertures 6 may be adjusted according to the inner diameter of the throttle passage 35, while adjusting, rather than based only on the inner diameter of the throttle passage 35, the cross-sectional area of another narrow groove provided in the vent passage, the inner diameter of holes, and the like (for example, in the embodiment depicted in FIG. 1, the area of opening of the ambient air introducing hole 31 and the groove diameter of the communication groove 37). In this way, the resistance to be applied against ambient air (air) flowing through the passage may be adjusted from broader perspective based on a combination of the resistance resulting from the throttle passage 35 and the resistance resulting from the cross-sectional area of another narrow groove and from holes.

In the first embodiment, the check valve 21A is shown to have the valve body 21*b* integrally formed with the partition wall 21*a*. However, this may not always be the case, and any other configuration is also possible as long as it is configured to open and close the dispensing passage 16. Moreover, the shape of the valve body 21*b* is not limited to a planer shape, and the valve body 21*b* may be of any shape that allows for opening and closing of the dispensing passage 16.

A second embodiment of the disclosure will be described below.

Figure 7:
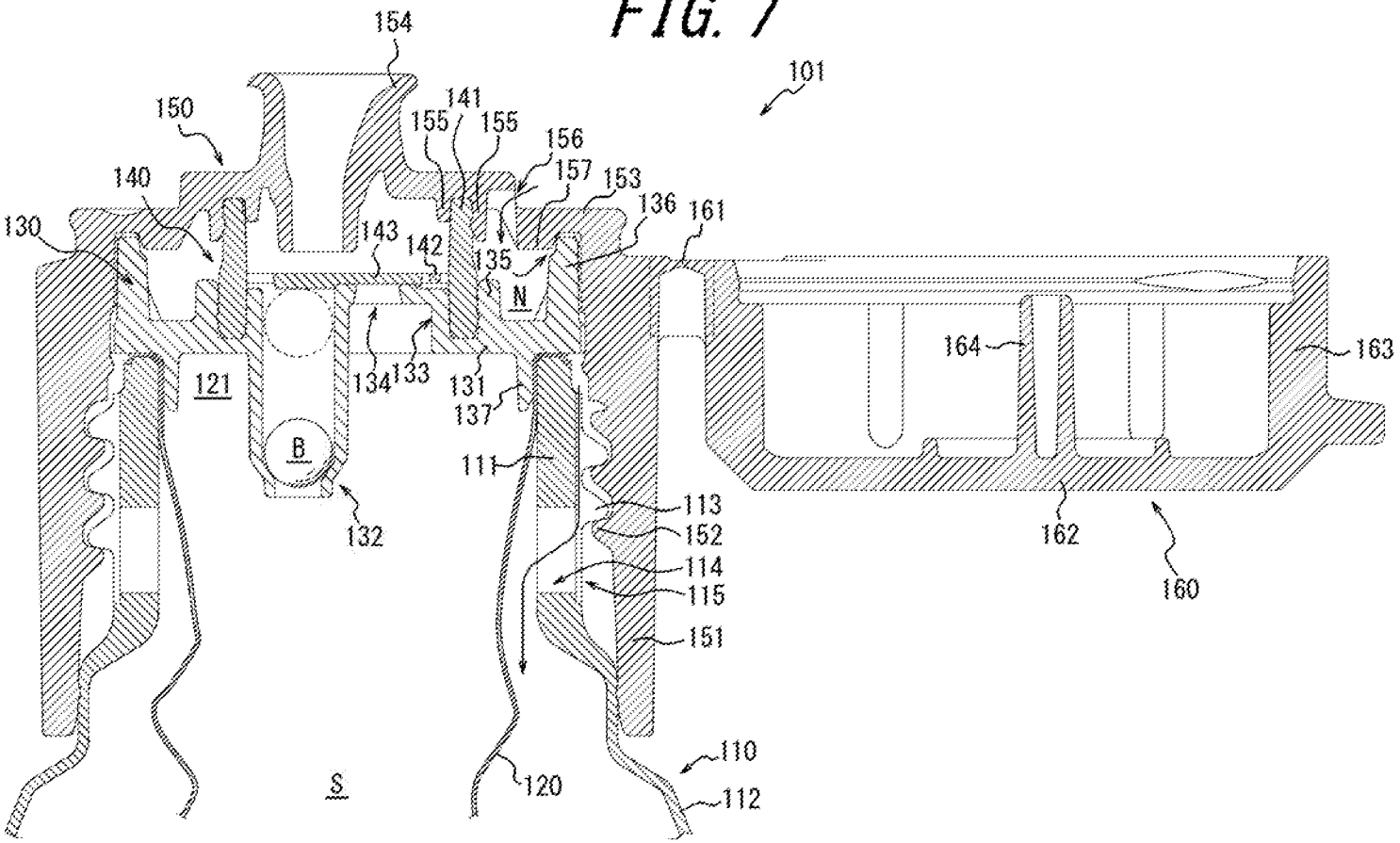
FIG. 7 is a sectional view of a part of a double container according to a second embodiment of the disclosure.
Figure 8:
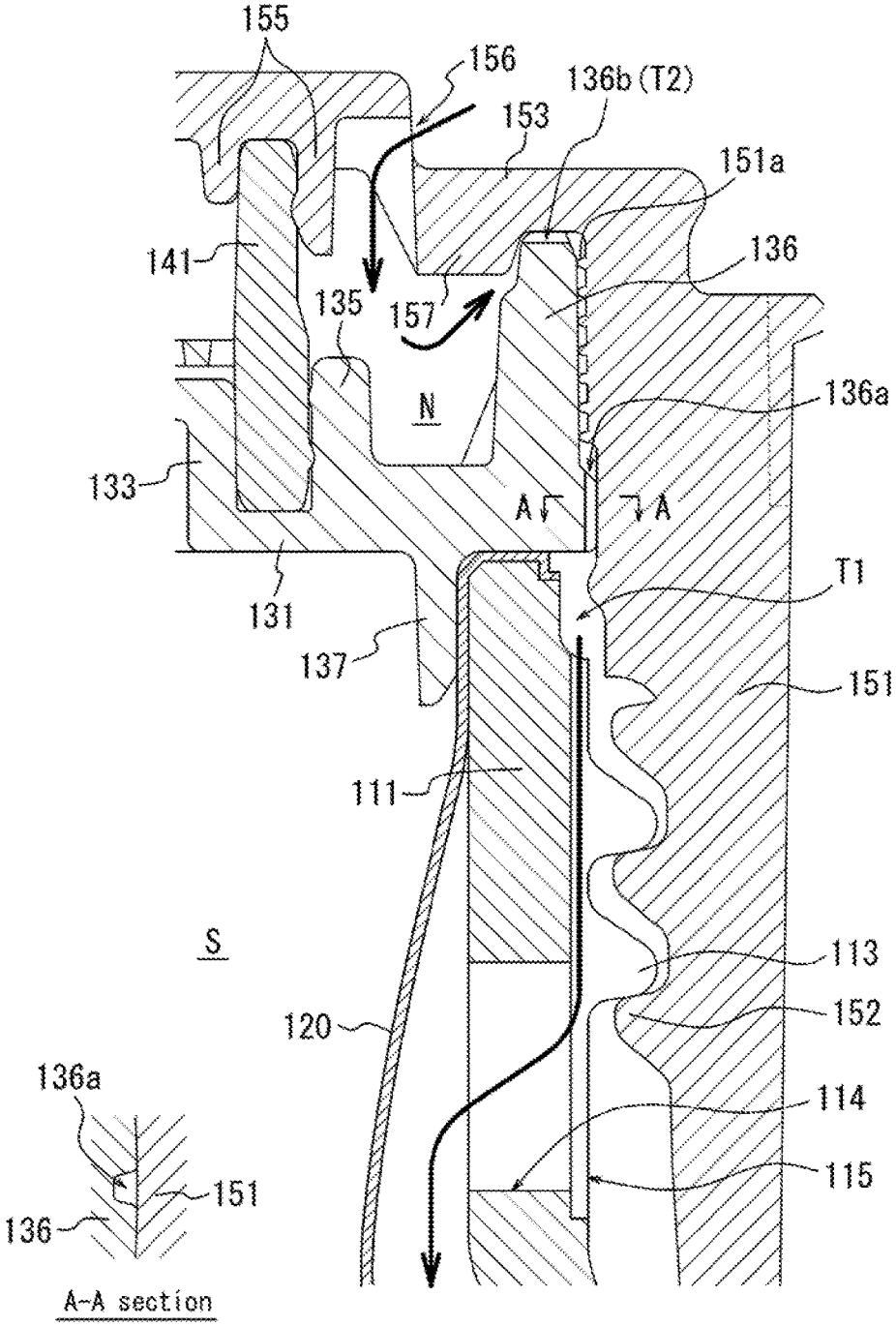
FIG. 8 is a partially enlarged sectional view of the double container in FIG. 7.

FIG. 7 is a sectional view of a part of a double container according to the second embodiment of the disclosure, and FIG. 8 is a partially enlarged sectional view of the double container depicted in FIG. 7.

In FIG. 7, reference numeral 101 denotes the double container according to the second embodiment of the disclosure. The double container 101 includes an outer layer body 110 constituting an outer shell and an inner layer body 120 accommodated in the outer layer body 110. The double container 101 also includes, in an upper portion thereof, an inside plug 130, a content check valve 140, a dispensing cap (dispensing plug) 150, and an over cap (cap body) 160.

The double container 101 in the second embodiment has a laminated structure with the outer layer body 110 and the inner layer body 120 that are made of relatively incompatible synthetic resins, and the double container 1 is obtained by blow molding a parison prepared by laminating these synthetic resin materials. Furthermore, although not illustrated, one or more bonding strips extending vertically between the outer layer body 110 and the inner layer body 120 may be provided for partially bonding the outer layer body 110 to the inner layer body 120.

The outer layer body 110 includes a cylindrical mouth portion (a mouth-portion circumferential wall) 111, a trunk portion 112 that is flexible and restorable and that is connected to the mouth portion 111, and a bottom portion (not illustrated) connected to the trunk portion 112. The mouth portion 111 includes an outer circumferential surface on which a male screw portion 113 is provided. The mouth portion 111 is also provided with an aperture (through hole) 114. Moreover, the mouth portion 111 is provided with a groove portion 115 on its outer circumferential surface at the location where the aperture 114 is formed. The groove portion 115 cuts out the male screw portion 113 in the vertical direction.

The inner layer body 120 defines, inside thereof, a containing space (filled space) S that may be filled with a content, and the inner layer body 120 also has an upper opening 121 communicating with the containing space S. The inner layer body 120 may be peeled from the laminated outer layer body 110 and deformed to undergo volume reduction.

The inside plug 130 has a main body portion (ceiling wall) 131 covering the upper opening 121 of the inner layer body 120. In this embodiment, the main body portion 131 is provided with a cylindrical tubular portion (tubular wall) 132 extending toward a container portion S. The tubular portion 132 has one end on the container portion S side whose diameter decreases toward the container portion S, and includes a ball (spherical body) B disposed therein that is displaceable by its own weight in response to a change in position of the outer layer body 110. The main body portion 131 is provided with a stepped portion 133 that is convex upward and that is adjacent to the tubular portion 132. The stepped portion 133 is provided with a dispensing passage (dispensing opening) 134 extending through the stepped portion 133. Moreover, the main body portion 131 includes an upper surface on which an annular fitting wall 135 is provided. The annular fitting wall 135 extends to surround the tubular portion 132 and the stepped portion 133 so that the content check valve 140 is fitted to and held by the annular fitting wall 135. Furthermore, a cylindrical inner circumferential wall (spacer portion) 136 standing from the edge of the main body portion 131 is provided radially outward of the fitting wall 135. Additionally, the main body portion 131 includes a lower surface on which an annular fitting tubular portion (sealing wall) 137 is provided. The annular fitting tubular portion 137 is fitted into the mouth portion 111 in a liquid tight manner.

The inner circumferential wall 136 will now be described in detail below referring to FIG. 8. In the second embodiment, the inner circumferential wall 136 includes an outer circumferential surface on which a narrow groove (communication groove) 136*a* extending in the vertical direction is provided. Additionally, the inner circumferential wall 136 includes an upper surface on which a narrow groove 136*b* extending in the radial direction (and having a similar structure to that of the narrow groove 136*a*) is provided.

The content check valve 140 is provided with a partition wall (annular wall) 141 whose lower portion is fitted to and held by the inside plug 130, the tubular portion 132, the stepped portion 133, and the fitting wall 135. A plate-like valve portion 143 is provided radially inward of the partition wall 141 and is connected thereto via a connecting piece (arm) 142. The valve portion 143 is configured to close the dispensing passage 134. The valve portion 143 covers a major part of the upper opening of the tubular portion 132. The valve portion 143 is, however, always in a partially opened position. In the second embodiment, the content check valve 140 is in the form of a so-called three-way valve, yet some other form of conventional check valve such as a one-way valve may be used. The partition wall 141 has a cylindrical shape in the second embodiment, yet may have a square tubular shape.

The dispensing cap 150 is connected to a cylindrical wall (outer circumferential wall) 151 surrounding the circumferential wall of the mouth portion 111. The cylindrical wall 151 includes an inner circumferential surface on which a female screw portion 152 corresponding to the male screw portion 113 on the circumferential wall of the mouth portion 111. The cylindrical wall 151 also includes an upper portion in which a top wall 153 is provided to cover the inside plug 130 and the content check valve 140. The top wall 153 is provided with a dispensing spout (dispensing tube) 154 that is configured to dispense the content in the container portion S when the content check valve 140 is in an opened position. Note that the dispensing spout 154 also extends below the top wall 153 and thus acts as a stopper for the valve portion 143 to prevent excessive upward displacement. Additionally, the top wall 153 includes a lower surface on which a pair of upper fitting walls 155 are provided in a concentric double arrangement such that the upper portion of the partition wall 141 is fitted to and held by the upper fitting walls 155. Moreover, an ambient air introducing hole 156 extending through the top wall 153 is provided radially outward of the upper fitting walls 155. With the above configuration, there is formed between the inner circumferential wall 136 and the partition wall 141 an inner space N that is sandwiched between the body portion 131 and the top wall 153 and to which the ambient air introducing hole 156 opens. Additionally, a projection 157 is provided on the lower surface of the top wall 153 to protrude toward the inner space N at a position between the ambient air introducing hole 156 and the inner circumferential wall 136.

The cylindrical wall 151 will now be described in detail below referring to FIG. 8. In this embodiment, a helical convex portion 151*a* protruding toward the inner circumferential wall 136 is provided in the upper portion of the inner circumferential surface of the cylindrical wall 151. Additionally, in a region near the narrow groove 136*a*, the inner circumferential surface of the cylindrical wall 151 is abutted against the outer circumferential surface of the inner circumferential wall 136 at locations other than where the narrow groove 136*a* is formed, while in a region near the narrow groove 136*b*, the lower surface of the top wall 153 is abutted against the upper surface of the inner circumferential wall 136 at locations other than where the narrow groove 136*b* is formed. With this configuration, an air flow passage (a vent region) is formed between the aperture 114 and the ambient air introducing hole 156 by: a vent passage T1 extending via the groove portion 115 over the narrow groove 136*a* and through the helical convex portion 151*a;* a connection passage T2 formed by the narrow groove 136*b;* and the inner space N connecting the connection passage T2 and the ambient air introducing hole 156. Although not illustrated, a convex rib extending in the vertical direction is provided on the outer circumferential surface of the inner circumferential wall 136, and is configured to engage with the helical convex portion 151*a* when the inside plug 130 is assembled with the dispensing cap 150. This arrangement causes the inside plug 130 to be held in a non-rotational manner relative to the dispensing cap 150.

Between the mouth portion 111 and the trunk portion 112 of the outer layer body 110, a cylindrical fitting portion that is larger in diameter than the mouth portion 111 is integrally provided. The fitting portion includes an outer circumferential surface to which the cylindrical wall 151 of the dispensing cap 150 is fitted in its lower end portion. With this configuration, the vent region that is formed by the vent passage T1, the connection passage T2, the inner space N, and the like is sealed at its lower end and partitioned from the outside of the dispensing cap 150.

The over cap (cap body) 160 is connected to the cylindrical wall 151 of the dispensing cap 150 via a hinge 161. The hinge 161 can be bent to cause the over cap 160 to cover the dispensing spout 154 and the ambient air introducing hole 156. More specifically, the over cap 160 is provided with a planer upper wall 162 and a cap-body circumferential wall 163 that connects to the edge of the upper wall 162 and that is shaped to be contiguous with the cylindrical wall 151. The upper wall 162 is provided with a plug body (rod body) 164 that is, when the over cap 160 is closed, configured to be fitted into the dispensing spout 154 to seal the dispensing spout 154. The over cap 160 may be prepared separately from the dispensing cap 150 without providing the hinge 161, and configured to be attached to the dispensing cap 150 by a screw or undercut.

At the time of dispensing the content from the double container 101 according to the second embodiment configured as above, the over cap 160 is opened as illustrated in FIG. 7, and the double container 101 is changed in position from an upright position to a tilted or inverted position. As a result, the ball B in the tubular portion 132 is displaced by its own weight to the position as indicated by dashed line in FIG. 7 (to the dispensing spout 154 side). Then, upon the trunk portion of the outer layer body 110 being pressed, the inner layer body 120 is pressed by the air held between the outer layer body 110 and the inner layer body 120, and the container portion S is pressurized. Then, the pressurized content raises the valve portion 143, causing the content to flow out of the dispensing passage 134 and to be discharged from the dispensing spout 154 to the outside. In this respect, the aperture 114 and the ambient air introducing hole 156 are connected to each other via the vent passage T1, the connection passage T2, and the inner space N, and are always in an opened position. The narrow groove 136*a* and the narrow groove 136*b* are, however, smaller in passage cross-sectional area (such as groove width and groove depth) than other regions of the vent passage T1, the connection passage T2, and the inner space N, and serve as throttle passages. Consequently, even upon the outer layer body 110 being pressed, there will not be a significant amount of air flowing out from between the outer layer body 110 and the inner layer body 120, and the content dispensing functionality comparable to conventional techniques can be maintained. In particular, the second embodiment provides the helical convex portion to increase the distance by which the vent passage T1 extends, and can prevent flow out of air in a more effective manner.

After the required amount of content is dispensed, and upon the pressure on the trunk portion of the outer layer body 110 being released, the pressure in the container portion S drops to cause the valve portion 143 to close the dispensing passage 134, thereby effectively preventing ambient air from flowing into the container portion S. Additionally, as the outer layer body 110 tries to restore its original shape by its own restoring force, a negative pressure is created between the outer layer body 110 and the inner layer body 120. Then, air is introduced from the ambient air introducing hole 156 via the inner space N over the connection passage T2 through the vent passage T1 into the aperture 114. As a result, the outer layer body 110 is allowed to restore its original shape while the volume of the inner layer body 120 remains reduced. Although air flow is restricted by the narrow groove 136*a* and the narrow groove 136*b*, the restoring force of the outer layer body 110 can be adjusted by varying the material, thickness, shape, and the like, and the outer layer body 110 is allowed to restore its original shape in a time comparable to that required when using an air check valve, by setting appropriate passage cross-sectional areas (such as groove width and groove depth) of the narrow groove 136*a* and the narrow groove 136*b* while maintaining their throttle functionality. In other words, according to the present disclosure, the intended performance can be obtained by varying the width, depth, and the like of the narrow groove, such adjustment is easily accomplished as compared to when using an air check valve with a more complicated structure, and no conventionally-used air check valve is required, which fact may also lead to a reduction in cost.

If liquid is present near the ambient air introducing hole 156, it may be drawn into the dispensing cap 150 together with air. Such liquid, however, will be introduced into the inner space N and, as the connection passage T2 is located above the inner space N, can be effectively prevented from flowing into the vent passage T1. Additionally, in this embodiment, the projection 157 is provided on the lower surface of the top wall 153 in a manner such that the projection 157 lies between the ambient air introducing hole 156 and the connection passage T2. This arrangement may prevent any liquid coming from the ambient air introducing hole 156 from directly flowing into the connection passage T2, and thus from flowing into the vent passage T1 in a more reliable manner. In other words, any liquid drawn from the ambient air introducing hole 156 can be introduced into and pooled in the inner space N and, since the connection passage T2 is located above the inner space N, such liquid can be effectively prevented from entering into the back of the dispensing cap 150 or between the outer layer body 110 and the inner layer body 120.

After dispensing the content, when the double container 101 is returned to an upright position, the ball B is displaced by its own weight to the container portion S side. Consequently, any content remaining in the dispensing spout 154 can be drawn into the dispensing cap 150, thereby preventing the content from dripping from the dispensing spout 154.

In this way, the double container 101 according to the second embodiment of the disclosure includes: the inner space N that connects to the ambient air introducing hole 156 and that is defined between the partition wall 141 provided in the content check valve 140 and the inner circumferential wall 136 provided in the inside plug 130; and the connection passage T2 that connects the inner space N and the vent passage T1 (connecting to the aperture 114 provided in the mouth portion 111 of the outer layer body 110) and that is provided between the upper surface of the inner circumferential wall 136 and the lower surface of the top wall 153 of the dispensing cap 150.

With this configuration, any liquid sucked from the ambient air introducing hole 156 can be introduced into and pooled in the inner space and, since the connection passage T2 is located above the inner space N, such liquid can be effectively prevented from entering into the back of the dispensing cap 150 or between the outer layer body 110 and the inner layer body 120.

In the double container 101 according to the second embodiment of the disclosure, at least one of the vent passage T1 and the connection passage T2 is used as a throttle passage for restricting air flow. This arrangement enables the air held between the outer layer body 110 and the inner layer body 120 to remain in the container to some extent while the outer layer body 110 is being pressed, and thus makes it possible to dispense the content without an air check valve. The throttle passage may be configured by the narrow groove 136*a* that is provided on at least one of the outer circumferential surface of the inner circumferential wall 136 and the inner circumferential surface of the cylindrical wall 151, or by the narrow groove 136*b* that is provided on at least one of the upper surface of the inner circumferential wall 136 and the lower surface of the top wall 153.

Moreover, in the double container 101 according to the second embodiment of the disclosure, if one of the inner circumferential wall 136 and the cylindrical wall 151 is provided with the helical convex portion 151*a* protruding toward the other, the vent passage T1 may be arranged to extend a longer distance. This arrangement may more effectively prevent leakage of air held between the outer layer body 110 and the inner layer body 120 from the ambient air introducing hole 156.

Furthermore, in the double container 101 according to the second embodiment of the disclosure, if the dispensing cap 150 is provided with the projection 157 protruding from the lower surface of the top wall 153 between the ambient air introducing hole 156 and the inner circumferential wall 136, it becomes possible to prevent any liquid sucked in from the ambient air introducing hole 156 from directly flowing into the connection passage T2. This arrangement may more reliably prevent liquid from entering into the back of the dispensing cap 150 or between the outer layer body 110 and the inner layer body 120.

Moreover, in the double container 101 according to the second embodiment of the disclosure, if the inside plug 130 is provided with the tubular portion 132 that extends toward the container portion S and the ball B that is displaceable inside the tubular portion 132 in response to a change in position of the outer layer body 110, when the outer layer body 110 is returned to the upright position after being tilted to dispense the content, the ball B is displaced toward the container portion S, which may cause the content to be sucked back from inside the dispensing spout 154. This arrangement may prevent the content from dripping from the dispensing spout 154, and thus improve usability.

In the second embodiment, air is introduced to the aperture 114 through the groove portion 115 provided in the outer layer body 110. The groove portion 115 may not be provided, however, and air may be introduced through the space between the male screw portion 113 and the female screw portion 152.

While two narrow grooves 136*a*, 136*b* are provided in the second embodiment, only one of them may be provided. In addition, any part other than the narrow groove 136*a* may be smaller in passage cross-sectional area than other regions of the vent passage T1. While the narrow grooves 136*a*, 136*b* have been described as being provided on the inner circumferential wall 136, these grooves may be provided on the cylindrical wall 151, or respectively divided into two parts to be provided on respective walls. Moreover, while the helical convex portion 151*a* has been described as being provided on the cylindrical wall 151, it may be provided on the inner circumferential wall 136, or on both. Furthermore, the outer layer body 110 and the inner layer body 120 are not limited to the ones obtained by blow molding a parison having a layered structure, and may be formed separately and subsequently assembled such that the inner layer body 120 is incorporated into the outer layer body 110.

A third embodiment of the disclosure will be described below.

Figure 9:
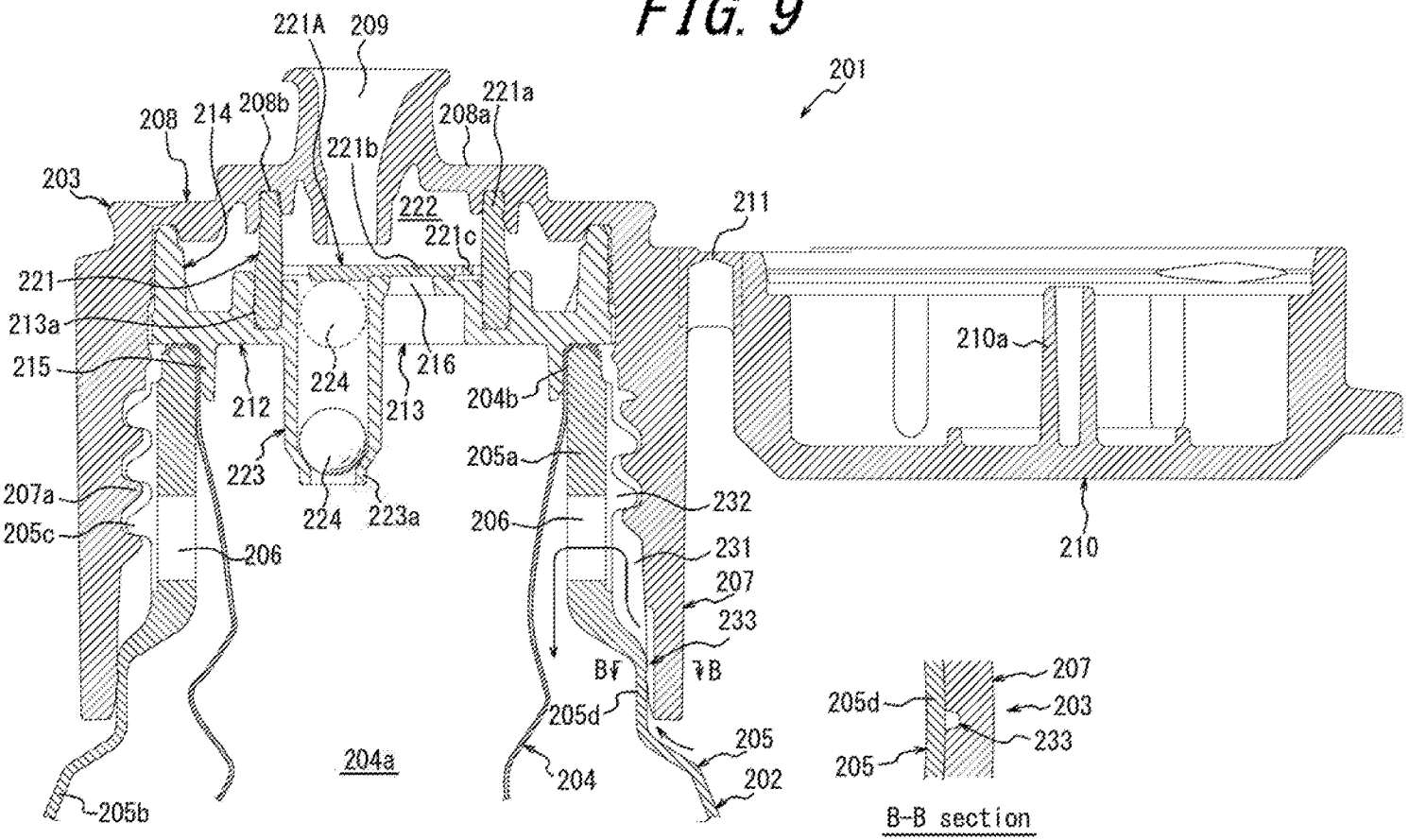
FIG. 9 is a sectional view of a part of a double container according to a third embodiment of the disclosure.

FIG. 9 illustrates a double container 201 according to the third embodiment of the disclosure. The double container 201 is configured to contain, for example, a liquid content such as food seasoning, and has a container body 202 and a dispensing cap 203. The container body 202 has a double-walled structure of peelable laminated type, including an inner layer body 204 and an outer layer body 205. The dispensing cap 203 is fitted to a mouth portion 205*a* that is provided in the outer layer body 205. The container body 202 is not limited to the peelable laminated type, and may be of the assembled type such that the inner layer body (inner container) 204 and the outer layer body (outer container) 205 are formed separately and assembled together.

The inner layer body 204 constituting the container body 202 is formed into a flexible bag body made of, for example, thin synthetic resin, and the inside of which is a container portion 204*a* for containing a content. The inner layer body 204 has in its upper end portion an upper opening 204*b* contiguous with the container portion 204*a*. The content contained in the container portion 204*a* can be dispensed from the upper opening 204*b*.

The outer layer body 205 forms an outer shell of the container body 202, and has the mouth portion 205*a* and a trunk portion 205*b* that is integrally connected to the mouth portion 205*a*. The outer layer body 205 accommodates the inner layer body 204 in a manner such that the inner layer body is peelable from the outer layer body. The mouth portion 205*a* of the outer layer body 205 includes an opening edge to which the upper opening 204*b* of the inner layer body 204 is fixed.

The mouth portion 205*a* of the outer layer body 205 has a cylindrical shape, and includes an outer circumferential surface that is integrally provided with a male screw portion 205*c*. A pair of apertures 206, each extending through the mouth portion 205*a* along a radial direction, are also provided in the mouth portion 205*a* of the outer layer body 205. These apertures 206 communicate between the inner layer body 204 and the outer layer body 205, and therefore, ambient air can be introduced between the inner layer body 204 and the outer layer body 205 through the apertures 206. The number of apertures is not so limited, and it suffices to provide at least one aperture 206.

The dispensing cap 203 has a topped cylindrical shape including a cylindrical wall 207 and a top wall 208 that is contiguous with the upper end of the cylindrical wall 207. The cylindrical wall 207 includes an inner circumferential surface on which a female screw portion 207*a* is integrally formed. The dispensing cap 203 is mounted on the mouth portion 205*a* of the outer layer body 205 with the female screw portion 207*a* being screwed to a male screw portion 205*c* that is provided in the mouth portion 205*a* of the outer layer body 205. When the dispensing cap 203 is mounted on the mouth portion 205*a*, the cylindrical wall 207 covers the outer circumference of the mouth portion 205*a* and the top wall 208 covers over the mouth portion 205*a*.

On the top wall 208 of the dispensing cap 203, a cylindrical stepped portion 208*a* protruding upward is provided. The stepped portion 208*a* is integrally provided with a dispensing spout (nozzle) 209 that is axially offset from the top wall 208. The dispensing spout 209 protrudes in a flared form from the upper surface of the stepped portion 208*a* in the top wall 208, while protruding in a cylindrical form from the lower surface of the stepped portion 208*a* and extending through the top wall 208. The dispensing spout 209 is in communication with the upper opening 204*b* of the inner layer body 204 so that the content contained in the inner layer body 204 can be dispensed to the outside. As used herein, the term "above" is used to refer to the side on which the upper opening 204*b* is provided relative to the container portion 204*a* of the inner layer body 204.

The dispensing cap 203 is provided with an over cap 210 that is openable and closable about a hinge 211. The over cap 210 has a topped cylindrical shape that is substantially the same in diameter as the dispensing cap 203, and can engage with the dispensing cap 203 by means of an undercut or the like to hold the dispensing cap 203 in a closed position. The over cap 210 includes an inner surface with which a cylindrical plug body 210*a* is integrally formed and from which the cylindrical plug body 210*a* protrudes. When the over cap 210 is closed, the cylindrical plug body 210*a* is fitted into the dispensing spout 209 so that the dispensing spout is blocked by the cylindrical plug body.

An inside plug 212 is mounted on the upper opening 204*b* of the inner layer body 204. The inside plug 212, which is made of, for example, synthetic resin, is provided with a substantially disk-shaped main body portion 213 and a cylindrical inner circumferential wall (spacer portion) 214 that protrudes upward from an outer circumferential edge of the main body portion 213. The inner circumferential wall 214 has an outer diameter that is substantially the same as the inner diameter of the cylindrical wall 207 of the dispensing cap 203. The inside plug 212 is located inside the dispensing cap 203, with an outer circumferential surface of the inner circumferential wall 214 being fitted to the inner circumferential surface of the cylindrical wall 207 and the upper end of the inner circumferential wall 214 being abutted against the top wall 208 in an axial direction. By providing the inner circumferential wall 214, space is formed between the inside plug 212 mounted on the dispensing cap 203 and the top wall 208 of the dispensing cap 203. The main body portion 213 of the inside plug 212 includes a lower surface, i.e., a surface facing the container portion 204*a* side of the inner layer body 204, which is coaxially and integrally formed with a cylindrical fitting tubular portion 215. The fitting tubular portion 215 is fitted into the mouth portion 205*a* in a liquid tight manner. Additionally, the main body portion 213 of the inside plug 212 is provided with a dispensing passage 216 that is formed as a through hole extending through the main body portion 213. The dispensing passage 216 places the container portion 204*a* of the inner layer body 204 in communication with the dispensing spout 209 of the dispensing cap 203.

A valve unit 221 that is made of, for example, synthetic resin, rubber, elastomer, or silicon is mounted in the space between the dispensing cap 203 and the inside plug 212. The valve unit 221 has a cylindrical partition wall 221*a*. The partition wall 221*a* has one axial end fitted into an annular groove 213*a* that is formed on the upper surface of the main body portion 213 of the inside plug 212, and the other axial end fitted into an annular groove 208*b* that is formed coaxially with the annular groove 213*a* on the lower surface of the top wall 208 of the dispensing cap 203. This configuration fixes the partition wall 221*a* between the dispensing cap 203 and the inside plug 212. The interior space of the dispensing cap 203 defined by the partition wall 221*a* is a dispensing region 222 that connects the dispensing passage 216 and the dispensing spout 209. The content dispensed from the dispensing passage 216 is caused to flow through the dispensing region 222 to the dispensing spout 209.

A check valve 221A is provided radially inward of and integrally with the partition wall 221*a* to prevent ambient air from being introduced from the dispensing passage 216 into the container portion 204*a* of the inner layer body 204. The check valve 221A has a disk-shaped valve body 221*b* that is coaxial with the partition wall 221*a*. The valve body 221*b* is connected at its outer circumferential edge to the inner circumferential surface of the partition wall 221*a* by a plurality of (e.g., three) elastically deformable connecting pieces 221*c*, and is displaceable in an axial direction thereof (in the vertical direction), relative to the partition wall 221*a*, in response to the elastic deformation of these connecting pieces 221*c*. The valve body 221*b* is located on an opening edge of the dispensing passage 216 facing the dispensing spout 209 side to block the dispensing passage 216. When pressure is applied to the content contained in the inner layer body 204 upon, for example, the outer layer body 205 being squeezed, the valve body 221*b* opens and the content is caused to circulate from the dispensing passage 216 toward the dispensing spout 209. On the other hand, upon the content being released from the pressure after dispensing of the content, the valve body 221*b* is returned by elastic force of the connecting pieces 221*c* to the position to block the dispensing passage 216. This arrangement prevents ambient air from flowing through the dispensing passage 216 into the container portion 204*a* of the inner layer body 204.

The main body portion 213 of the inside plug 212 is formed integrally with a cylindrical tubular portion 223 that is adjacent to the dispensing passage 216. The tubular portion 223 opens to the container portion 204*a* of the inner layer body 204 and to the dispensing region 222 of the dispensing cap 203. A ball 224 having a spherical shape, which is made of steel material, resin material, or the like, is located inside the tubular portion 223. The ball 224 has a diameter substantially the same as the inner diameter of the tubular portion 223, and is displaceable in the axial direction inside the tubular portion 223. The tubular portion 223 includes a lower end that is integrally provided with a diameter-decreasing portion 223*a*, and an upper end on which the valve body 221*b* is partially located. Consequently, the ball 224 is held inside the tubular portion 223. The ball 224 is positioned by its own weight at one end of the tubular portion 223 on the container portion 204*a* side when the double container 201 is in an upright position with the dispensing cap 203 on top. Alternatively, when the content is dispensed from the double container 201 at an inclination of 90° or more with respect to the upright position, the ball 224 is displaced to the other end of the tubular portion 223 on the dispensing region 222 side, as indicated by dashed line in FIG. 9. When the double container 201 is returned to the upright position subsequent to the dispensing of the content in the above state, the ball 224 is displaced inside the tubular portion 223 away from the dispensing region 222 and toward the container portion 204*a* side, and as a consequence, any content left in the dispensing spout 209, the dispensing region 222, or the like will be drawn (or sucked back) into the tubular portion 223. This arrangement can effectively prevent dripping of the content from the tip of the dispensing spout 209.

The space between the cylindrical wall 207 of the dispensing cap 203 and the mouth portion 205*a* of the outer layer body 205 is a vent region 231. The apertures 206 provided in the mouth portion 205*a* of the outer layer body 205 open to the vent region 231. The male screw portion 205*c* provided in the mouth portion 205*a* is provided with a slit-like groove portion 232 that extends along the axial direction. The groove portion 232 also forms part of the vent region 231.

Between the mouth portion 205*a* of the outer layer body 205 and the trunk portion 205*b*, a cylindrical fitting portion 205*d* that is larger in diameter than the mouth portion 205*a* is integrally provided. The fitting portion 205*d* includes an outer circumferential surface to which a lower end portion of the cylindrical wall 207 of the dispensing cap 203 is fitted. In this way, the vent region 231 is sealed at its lower end and partitioned from the outside of the dispensing cap 203. The vent region 231 is sealed at its upper end, with the lower surface of the inside plug 212 being abutted against the opening edge (upper end) of the mouth portion 205*a*, and the upper end of the inner circumferential wall 214 being abutted against the inner surface of the top wall 208 of the dispensing cap 203.

To cause ambient air to be introduced to the apertures 206 provided in the mouth portion 205*a* of the outer layer body 205, the dispensing cap 203 is provided with a throttle passage 233 that is located below the upper opening 204*b* of the inner layer body 204 (on the container portion 204*a* side relative to the upper opening 204*b*). As depicted in a sectional view taken along a line B-B in FIG. 9, the throttle passage 233 is formed in the form of a groove, which has a rectangular shape in a section thereof and which extends along the axial direction of the cylindrical wall 207 on the inner circumferential surface of the lower end portion of the cylindrical wall 207 fitted to the outer circumferential surface of the fitting portion 205*d* of the outer layer body 205. The throttle passage 233 is connected at its upper end to the vent region 231, and opens on the lower end side of the cylindrical wall 207 to the outside of the dispensing cap 203, thereby placing the vent region 231 in communication with the outside. The throttle passage 233 also serves as an orifice, which may create a predetermined resistance to ambient air (air) flowing between the outside of the dispensing cap 203 and the vent region 231 through the throttle passage 233.

With the above configuration, when the inner layer body 204 undergoes volume reduction in response to dispensing of the content, ambient air can be introduced from the throttle passage 233 via the vent region 231 to the apertures 206, i.e., between the inner layer body 204 and the outer layer body 205, so that only the inner layer body 204 undergoes volume reduction.

On the other hand, when the outer layer body 205 is squeezed for dispensing the content, air left between the inner layer body 204 and the outer layer body 205 tries to escape, due to an increase in pressure of the air, from the apertures 206 via the throttle passage 233 toward the outside of the dispensing cap 203. However, since the throttle passage 233 serves as an orifice, even when the pressure of air between the inner layer body 204 and the outer layer body 205 increases in response to the squeezing of the outer layer body 205, there is a considerable resistance to the passage of such air through the throttle passage 233, preventing the air from readily flowing out to the outside. In other words, the pressure of air between the inner layer body 204 and the outer layer body 205 increased by squeezing the outer layer body 205 will drop gradually, not rapidly. Accordingly, when the outer layer body 205 is squeezed for dispensing the content, the pressure of air between the inner layer body 204 and the outer layer body 205 can be maintained high enough for a while for the content to be dispensed from the inner layer body 204. This arrangement enables the inner layer body 204 to be compressed by the pressurized air between the inner layer body 204 and the outer layer body 205 in response to the squeezing of the outer layer body 205, so that the content contained in the container portion 204*a* of the inner layer body 204 is caused to be dispensed from the dispensing spout 209 of the dispensing cap 203 to the outside.

To achieve the above functionality, the cross-sectional area of the throttle passage 233 formed in a groove-like manner is set based on the amount of the content to be dispensed, the rigidity of the outer layer body 205, the restoring force after squeezing, and the like, so that the content can be dispensed in response to the squeezing of the outer layer body 205.

In this way, the dispensing cap 203 is provided with the throttle passage 233, through which ambient air is introduced and exhausted between the space existing between the inner layer body 204 and the outer layer body 205 and the outside of the dispensing cap 203. This arrangement may cause ambient air to be introduced from the throttle passage 233 to the apertures 206, i.e., between the inner layer body 204 and the outer layer body 205, in response to dispensing of the content, while enabling the air held between the inner layer body 204 and the outer layer body 205 to be maintained at high pressure when the outer layer body 205 is squeezed for dispensing the content, so that the content contained in the inner layer body 204 can be dispensed from the dispensing spout 209 of the dispensing cap 203 to the outside. Moreover, the throttle passage 233 is integrally provided in a groove-like manner with the cylindrical wall 207 of the dispensing cap 203, which fact eliminates the need for additional parts such as a check valve, and thus may reduce the number of parts required for the double container 201, thereby reducing the cost of the double container.

Moreover, since the throttle passage 233 is provided below the upper opening 204*b* of the inner layer body 204, it is possible to simplify the structure of the inside plug 212 and of the dispensing cap 203 for those parts, other than the grooves, in association with the provision of the throttle passage 233, thereby further reducing the cost of the double container 201.

Figure 10:
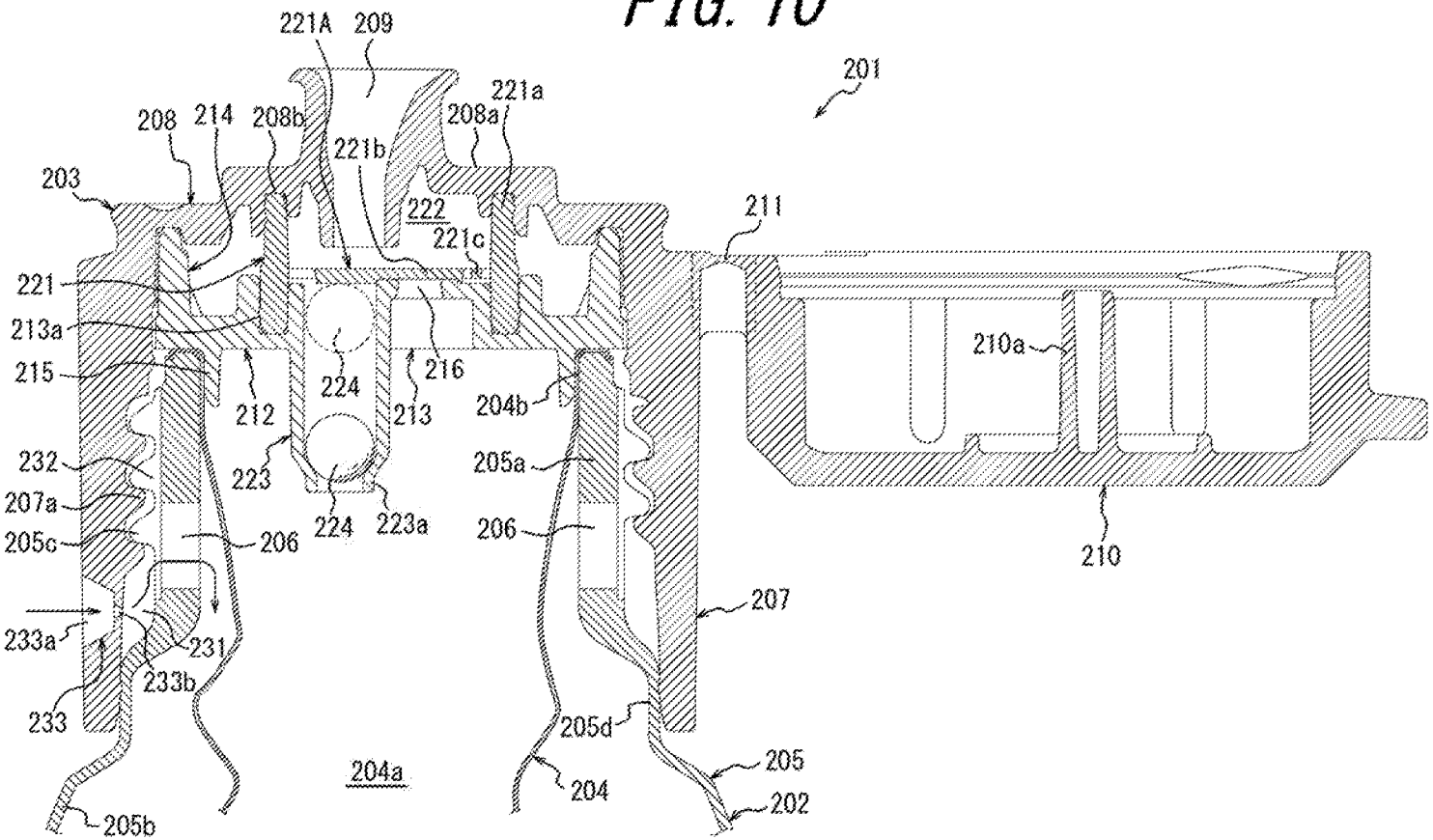
FIG. 10 is a sectional view of a variation of the double container in FIG. 9, where a throttle passage is provided in the cylindrical wall of the dispensing cap.

FIG. 10 is a sectional view of a variation of the double container in FIG. 9, where a throttle passage is provided in the cylindrical wall of the dispensing cap. In FIG. 10, members corresponding to those described in FIG. 9 are denoted by the same reference numerals.

In the variation in FIG. 10, the throttle passage 233 is provided in the cylindrical wall 207 of the dispensing cap 203, as a through hole extending through the cylindrical wall 207 in the radial direction. In this case, the throttle passage 233 is also provided below the upper opening 204*b* of the inner layer body 204 and below the apertures 206.

In this variation, the throttle passage 233 has a large diameter-increasing hole 233*a* with a tapered inner surface and a small diameter-increasing hole 233*b* with a tapered inner surface that has a smaller diameter than the large diameter-increasing hole 233*a*. The large diameter-increasing hole 233*a* opens to the outside of the dispensing cap 203, while the small diameter-increasing hole 233*b* opens to the vent region 231.

In this case, the small diameter-increasing hole 233*b* of the throttle passage 233 serves as an orifice, which creates a predetermined resistance to ambient air (air) flowing between the outside of the dispensing cap 203 and the vent region 231 through the throttle passage 233. The configuration according to this variation may also achieve the similar effect to that of the embodiment described in FIG. 9.

In the third embodiment depicted in FIG. 9, the throttle passage 233 has been described as being provided in a groove-like manner in the lower end portion of the inner circumferential surface of the cylindrical wall 207 of the dispensing cap 203, while in the third embodiment depicted in FIG. 10, the throttle passage 233 has been described as being provided as a through hole extending through the cylindrical wall 207 of the dispensing cap 203. The throttle passage 233 is not so limited, however, and may be configured or arranged in other ways, as long as it is provided below the upper opening 204*b* of the inner layer body 204 so as to allow the vent region 231 to communicate with the outside.

In the third embodiment, the throttle passage 233 is preferably provided below the apertures 206 that are provided in the mouth portion 205*a* of the outer layer body 205. By providing the throttle passage 233 below the apertures 206, it becomes possible to prevent any foreign matter such as the content that has been dripped from the dispensing spout 209 and accidentally introduced from the throttle passage 233, from entering through the apertures 206 and the vent region 231 between the inner layer body 204 and the outer layer body 205.

Moreover, in the third embodiment, the valve body 221*b* that is arranged to open and close the dispensing passage 216 has been described as being integrally provided with the partition wall 221*a*. The valve body 221*b* is not so limited, however, and may be configured in other ways as long as it allows for opening and closing of the dispensing passage 216. Furthermore, the valve body 221*b* is not limited to the one having a planer shape, and may be of any shape that allows for opening and closing of the dispensing passage 16.

A fourth embodiment of the disclosure will be described below.

Figure 11:
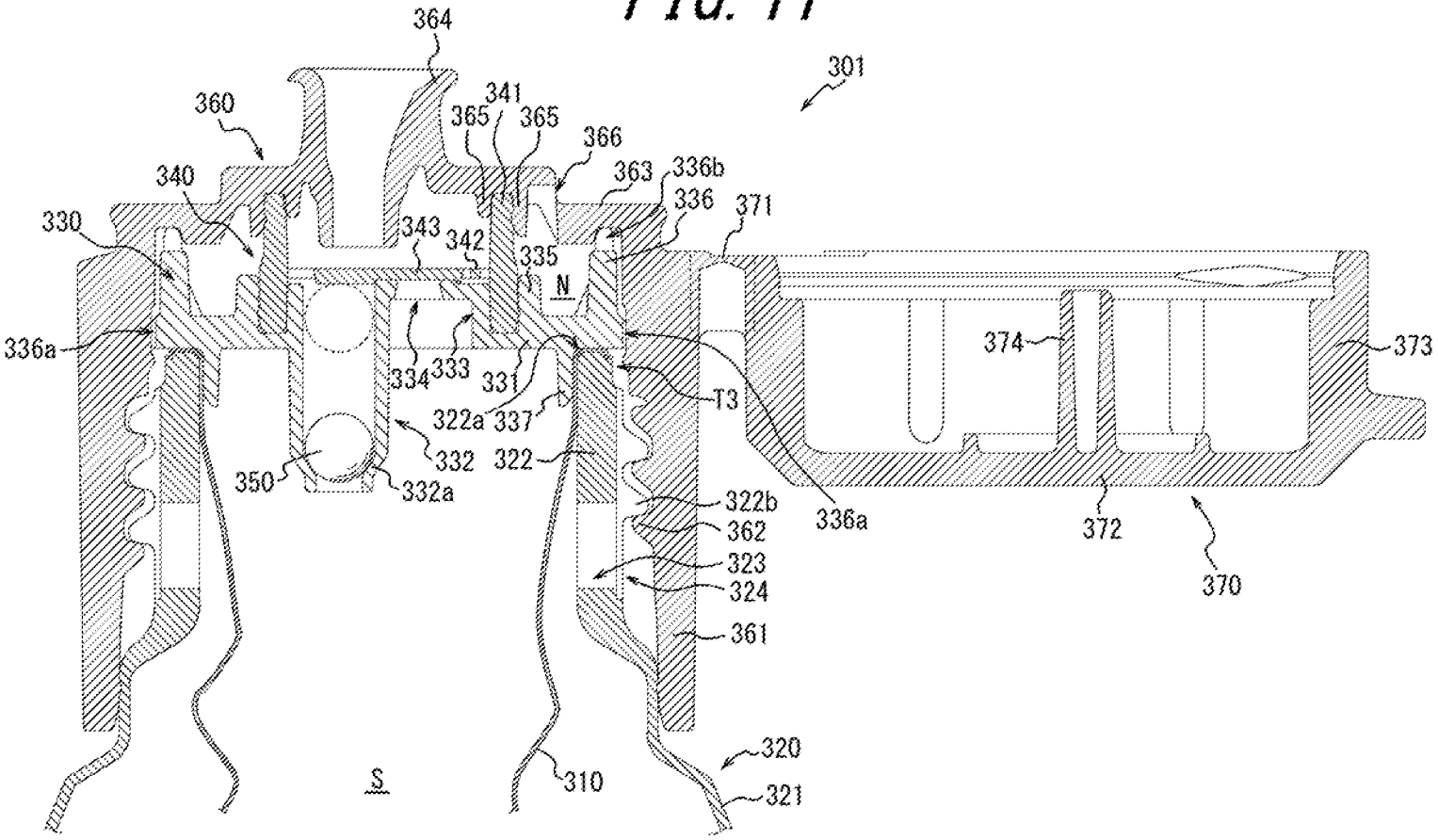
FIG. 11 is a sectional view of a part of a double container according to a fourth embodiment of the disclosure.

In FIG. 11, reference numeral 301 denotes the double container according to the fourth embodiment of the disclosure. The double container 301 includes an inner layer body 310 for containing a liquid content and an outer layer body 320 accommodating the inner layer body 310. The double container 301 also includes an inside plug 330, a check valve 340, a ball (displaceable valve) 350, a dispensing cap 360, and an over cap (cap body) 370.

The inner layer body 310 has inside thereof a container portion (filled space) S for containing the liquid content. The inner layer body 310 is made of thin synthetic resin, and is deformable to undergo volume reduction.

The outer layer body 320 has a trunk portion 321, which connects to the bottom portion (not illustrated), and a cylindrical stepped mouth portion (mouth-portion circumferential wall) 322, which is integrally connected to the trunk portion 321 and which has a larger diameter at the bottom than at the top. The mouth portion 322 is provided with an upper opening 322*a* that opens upward, and includes an outer circumferential surface on which a male screw portion 322*b* is provided. The mouth portion 322 is also provided with an aperture (through hole) 323, which is used for causing air to be introduced between the inner layer body 310 and the outer layer body 320. Moreover, the mouth portion 322 is provided with a groove portion 324 on its outer circumferential surface at the location where the aperture 323 is formed. The groove portion 324 cuts out the male screw portion 322*b* in the vertical direction.

The inner layer body 310 has an upper opening that is located inside the mouth portion 322 of the outer layer body 320 and that opens in connection with the upper opening 322*a* of the mouth portion 322.

The double container 301 in the fourth embodiment has a laminated structure with the inner layer body 310 and the outer layer body 320 that are made of relatively incompatible synthetic resins, and the double container 301 is obtained by blow molding a parison prepared by laminating these synthetic resin materials. Blow molding is merely an example, and the outer layer body and the inner layer body may be obtained by subjecting a preform having a test-tube-like shape to biaxial stretching blow molding, or may be formed separately and subsequently assembled such that the inner layer body is incorporated into the outer layer body. Furthermore, although not illustrated, one or more bonding strips extending vertically between the inner layer body 310 and the outer layer body 320 may be provided for partially bonding the inner layer body 310 to the outer layer body 320.

The inside plug 330 has a main body portion (ceiling wall) 331 covering the upper opening 322*a* of the outer layer body 320. In this embodiment, the main body portion 331 is provided with a tubular portion (tubular wall) 332 that extends through the main body portion 331 in the vertical direction and that extends toward the container portion S. The tubular portion 332 in this embodiment has a cylindrical shape such that the inner circumferential surface has a circular transverse section. The tubular portion 332, however, may have a square tubular shape such that the inner circumferential surface has a polygonal, such as triangular or pentagonal transverse section. The tubular portion 332 is also provided with a diameter-decreasing portion 332*a* whose inner diameter decreases from top to bottom. The main body portion 331 is provided with a stepped portion 333 that is convex upward and that is adjacent to the tubular portion 332. The stepped portion 333 is provided with a dispensing passage 334 extending through the stepped portion 333. Additionally, the main body portion 331 includes an upper surface on which an annular fitting wall 335 is provided. The annular fitting wall 335 extends to surround the tubular portion 332 and the stepped portion 333 so that the content check valve 340 is fitted to and held by the annular fitting wall 335. Furthermore, a cylindrical inner circumferential wall 336 standing from the edge of the main body portion 331 is provided radially outward of the fitting wall 335. Additionally, the main body portion 331 has a lower surface provided with an annular fitting tubular portion (sealing wall) 337 which is fitted into the mouth portion 322 in a liquid tight manner.

The inner circumferential wall 336 will now be described in detail below referring to FIG. 12. On the periphery of the inner circumferential wall 336, longitudinal grooves (groove portions) 336*a* extending in the vertical direction are provided. In the fourth embodiment, as depicted in a sectional view taken along a line C-C in FIG. 12, each of the communication grooves 336*a* has a triangular shape in a transverse section thereof, yet may be of any of a variety of shapes such as a semicircular or quadrilateral shape. As can be seen from FIG. 11, the fourth embodiment includes a total of two communication grooves 336*a* that are located in opposing positions. Moreover, the inner circumferential wall 336 includes an upper surface on which a transverse groove 336*b* extending in the radial direction is provided.

The content check valve 340 is provided with a partition wall (annular wall) 341 whose lower portion is fitted to and held by the tubular portion 332, the stepped portion 333, and the fitting wall 335 of the inside plug 330. A plate-like valve body 343 is provided radially inward of the partition wall 341 and is connected thereto via a connecting piece (elastic arm) 342. The valve body 343 is configured to close the dispensing passage 334. The valve body 343 covers a major part of the upper opening of the tubular portion 332. The valve body 343 is, however, always in a partially opened position. In this embodiment, the check valve 340 is in the form of a so-called three-way valve, yet some other form of conventional check valve such as a one-way valve may be used. The partition wall 341 has a cylindrical shape in this embodiment, yet may have a square tubular shape.

The ball 350 as a displaceable valve is provided inside the tubular portion 332 in a manner such that it is displaceable along the inner circumferential surface of the tubular portion. In the fourth embodiment, the ball 350 having a spherical shape is arranged as a displaceable valve inside the tubular portion 332. The displaceable valve, however, may take a variety of forms, such as a columnar solid object, an object having a cylindrical shape and including a closure wall for closing an inner passage formed therein, or the like. As illustrated in FIG. 11, when the double container 301 is in an upright position, the ball 350 is in a seated position on a diameter-decreasing portion 332*a* and closes the container portion S.

The dispensing cap 360 is provided with a cylindrical wall (outer circumferential wall) 361 surrounding the mouth portion 322. The cylindrical wall 361 includes an inner circumferential surface on which a female screw portion 362 corresponding to the male screw portion 322*b* of the mouth portion 322. The cylindrical wall 361 also includes an upper portion in which a top wall 363 is provided to cover the inside plug 330 and the check valve 340. The top wall 363 is provided with a dispensing spout (dispensing tube) 364 which is configured to dispense the content in the container portion S when the check valve 340 is in an opened position. Note that the dispensing spout 364 also extends below the top wall 363 and thus acts as a stopper for the valve body 343 to prevent excessive upward displacement. Additionally, the top wall 363 has a lower surface on which a pair of upper fitting walls 365 are provided in a concentric double arrangement such that the upper portion of the partition wall 341 is fitted to and held by the upper fitting walls 365. Moreover, an ambient air introducing hole 366 extending through the top wall 363 is provided radially outward of the upper fitting walls 365. With this arrangement, the dispensing spout 364 is partitioned from the ambient air introducing hole 366 by the partition wall 341, and an inner space N is formed radially outward of the partition wall 341. The ambient air introducing hole 366 opens to the inner space N.

Additionally, in regions near the communication grooves 336*a*, the inner circumferential surface of the cylindrical wall 361 is abutted against the outer circumferential surface of the inner circumferential wall 336 at locations other than where the communication grooves (longitudinal grooves) 336*a* as groove portions are formed, while in a region near the transverse groove 336*b*, the lower surface of the top wall 363 is abutted against the upper surface of the inner circumferential wall 336 at locations other than where the transverse groove 336*b* is formed. In other words, inside the dispensing cap 360 is formed an ambient air introducing passage (vent region) T3 as a passage for allowing ambient air to flow from the outside to the space between the inner layer body 310 and the outer layer body 320. The ambient air introducing passage (vent region) T3 extends from the ambient air introducing hole 366 to the aperture 323 via in sequence the inner space N, the transverse groove 336*b*, the space between the cylindrical wall 361 and the inner circumferential wall 336, the communication groove 336*a*, and the groove portion 324. In this embodiment, a total of two communication grooves 336*a* are provided, and thus two ambient air introducing passages T3 are formed. Note that one or three or more ambient air introducing passages T3 may be provided. In this embodiment, the communication grooves 336*a* each have the minimum cross-sectional area in the respective ambient air introducing passages T3. As used herein, the minimum cross-sectional area of each ambient air introducing passage T3 means one of cross-sectional areas that is the smallest in the path from the ambient air introducing hole 366 to the aperture 323, in a plane orthogonal to the direction in which the ambient air introducing passage T3 extends. In this embodiment, the cross-sectional area of each communication groove 336*a* in a horizontal plane is the smallest in the path from the ambient air introducing hole 366 to the aperture 323. In this respect, the sum of the cross-sectional area of respective communication grooves 336*a* in a horizontal plane is set within the range of 0.11 $mm^2$ to 0.19 $mm^2$.

Note that a cylindrical fitting portion that is larger in diameter than the mouth portion 322 is integrally provided between the mouth portion 322 and the trunk portion 321 of the outer layer body 320. The fitting portion includes an outer circumferential surface to which the cylindrical wall 361 of the dispensing cap 360 is fitted in its lower end portion. In this way, the vent region configured by the ambient air introducing passages T3 is sealed at its lower end and partitioned from the outside of the dispensing cap 360.

The over cap 370 is connected to the cylindrical wall 361 of the dispensing cap 360 via a hinge 371. The hinge 371 can be bent to cause the over cap 370 to cover the dispensing spout 364 and the ambient air introducing hole 366. More specifically, the over cap 370 is provided with a planer upper wall 372 and a cap-body circumferential wall 373 that connects to the edge of the upper wall 372 and that is shaped to be contiguous with the cylindrical wall 361. The upper wall 372 is provided with a plug body (rod portion) 374 that is, when the over cap 370 is closed, configured to be fitted into the dispensing spout 364 to seal the dispensing spout 364. The over cap 370 may be prepared separately from the dispensing cap 360 without providing the hinge 371, and configured to be attached to the dispensing cap 360 by a screw or undercut.

At the time of dispensing the content from the double container 301 configured as above, the over cap 370 is opened as illustrated in FIG. 11, and the double container 301 is changed in position from an upright position to a tilted or inverted position. Then, upon the trunk portion 321 of the outer layer body 320 being pressed, the inner layer body 310 is pressed directly by the outer layer body 320 itself, or by the air held between the inner layer body 310 and the outer layer body 320, and the container portion S is pressurized. Consequently, the pressurized liquid content from the dispensing passage 334 raises the valve body 343 to allow the liquid content to flow out of the dispensing passage 334 and to be discharged from the dispensing spout 364 to the outside. In this respect, the ambient air introducing passages T3 are always in an opened position. The sum of the cross-sectional area of the communication grooves 336*a* in a horizontal plane is, however, set within the range of 0.11 $mm^2$ to 0.19 $mm^2$. Consequently, the air held between the inner layer body 310 and the outer layer body 320 will not flow out in significant amounts from the ambient air introducing hole 366, and the liquid content can be dispensed favorably. In the above state, the ball 350, or the displaceable valve inside the tubular portion 332 is displaced, by its own weight and by the liquid content flowing from the lower opening of the tubular portion 332, to the dispensing spout 364 side (to the position as indicated by dashed line in FIG. 11).

After the required amount of content is dispensed, and upon the pressure on the trunk portion 321 of the outer layer body 320 being released, the pressure in the container portion S drops to cause the valve body 343 to close the dispensing passage 334, which may prevent ambient air from flowing into the container portion S. Additionally, as the outer layer body 320 tries to restore its original shape by its own restoring force, a negative pressure is created between the inner layer body 310 and the outer layer body 320. Then, ambient air is introduced from the ambient air introducing passages T3. As a result, the outer layer body 320 is allowed to restore its original shape while the volume of the inner layer body 310 remains reduced. As the sum of the cross-sectional area of the communication grooves 336*a* in a horizontal plane are set within the range of 0.11 $mm^2$ to 0.19 $mm^2$, there will not be a significant disruption to the introduction of ambient air, and it will not take too much time for the outer layer body to fully restore its original shape.

When the dispensing passage 334 is closed by the valve body 343, the liquid content still remains in the dispensing spout 364. When the double container 301 is returned to the upright position, the ball 350 is displaced downward by its own weight and due to a drop in pressure in the container portion S. Consequently, space is formed above the tubular portion 332 corresponding to the displacement of the ball 50, and the liquid content left in the dispensing spout 364 can be drawn, in the quantity corresponding to the space, into the tubular portion (suck-back function). This arrangement can effectively prevent dripping of the liquid content. After being displaced downward, the ball 350 seats on the diameter-decreasing portion 332*a* of the tubular portion 332, and may thus maintain the container portion S in a closed state.

In this way, in the double container 301 according to the fourth embodiment, the ambient air introducing passages T3 are provided inside the dispensing cap 360 as at least one vent region extending from the ambient air introducing hole 366 to the aperture 323, and the sum of the minimum cross-sectional area of the ambient air introducing passages T3 is set within the range of 0.11 $mm^2$ to 0.19 $mm^2$. Consequently, when the outer layer body 320 is being pressed, the air held between the outer layer body 320 and the inner layer body 310 will not flow out in significant amounts from the ambient air introducing hole 366, which fact enables the container portion S to be pressurized sufficiently and the liquid content to be dispensed favorably. Moreover, within the above range, it will not take too much time for the outer layer body 320 to fully restore its original shape, which poses no problem in practical use.

Moreover, in the double container 301 according to the fourth embodiment, setting of the sum of the minimum cross-sectional area of the ambient air introducing passages T3 within the above range may be achieved by, for example, providing one member with a through hole and setting the opening area of the through hole within the above range. With this arrangement, however, the through hole has a small inner diameter, and may thus be difficult to form. In contrast, if the ambient air introducing passages T3 are partially formed on at least one of the periphery of the inside plug 330 and the cylindrical wall 361 of the dispensing cap 360, and if groove portions (communication grooves 336*a*) are provided to have the minimum cross-sectional areas of the ambient air introducing passages T3, such groove portions are defined on the outer or inner surface of respective members, and may thus be easily formed.

Moreover, it is sometimes necessary for the double container 301 in the fourth embodiment to change the opening area of the dispensing passage 334 provided in the inside plug 330, for example, depending on the type of liquid content, and to optimize the sum of the minimum cross-sectional area of the ambient air introducing passages T3 within the above range accordingly. Even in this case if the aforementioned groove portions are provided in the inside plug 330, it is possible to use the same dispensing cap 360, which thus enables standardization of parts.

EXAMPLES

Example 1

Figure 12:
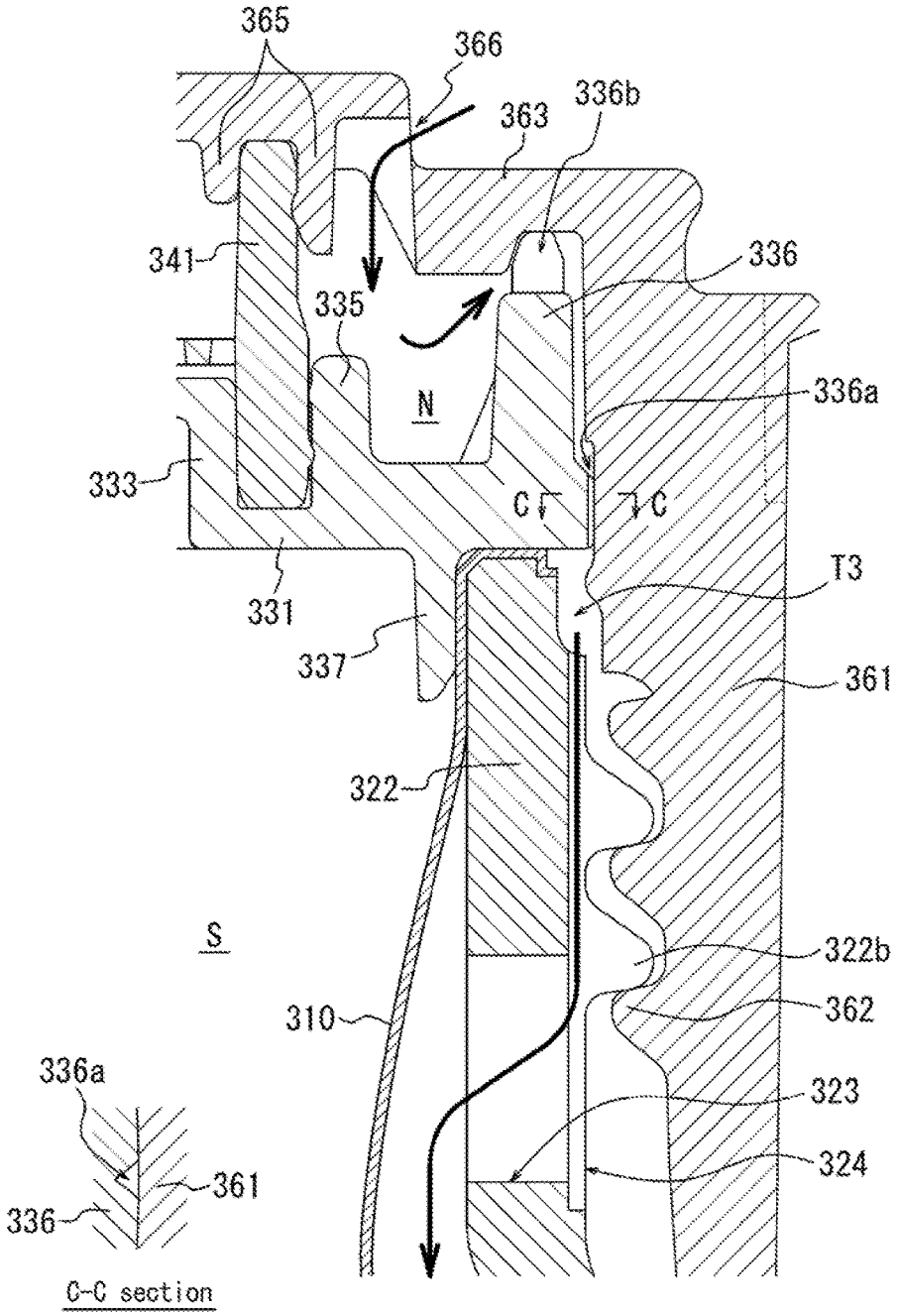
FIG. 12 is a partially enlarged sectional view of the double container in FIG. 11.

The double containers depicted in FIGS. 11 and 12 were studied to determine their liquid content dispensing performance and outer layer body restoration time upon the outer layer body being pressed. To this end, double containers were prepared by being filled with liquid content of the same type and in the same quantity, and setting different cross-sectional areas of two communication grooves 336*a* for different pairs so that the sum of the minimum cross-sectional area in the ambient air introducing passages varies for different double containers. The study was performed on these double containers by dispensing a predetermined amount of liquid content by pressing the outer layer bodies, and repeating the process. Table 1 lists the results, including the sum of the cross-sectional area of communication grooves 336*a*. The volume of each double container was 200 mL.

[Table 1]

TABLE 1

| | Sum of Minimum Cross-sectional Area in Ambient Air Introducing Passage [$mm^2$] | Liquid Content Dispensing Performance | Outer Layer Body Restoration Time (ave.) [s] |
|---|---|---|---|
| Comparative Example 1 | 0.08 | Good | 6.4 |
| Conforming Example 1 | 0.11 | Good | 5.5 |
| Conforming Example 2 | 0.13 | Good | 5.6 |
| Conforming Example 3 | 0.14 | Good | 4.2 |
| Conforming Example 4 | 0.16 | Good | 3.5 |
| Conforming Example 5 | 0.18 | Good | 3.1 |
| Conforming Example 6 | 0.19 | Good | 4.5 |
| Comparative Example 2 | 0.20 | Poor | 6.0 |
| Comparative Example 3 | 0.38 | Poor | 7.3 |

Liquid content dispensing performance was evaluated by determining whether the liquid content can be favorably dispensed by pressing the outer layer body. In the table, "Good" denotes a double container from which the liquid content could be dispensed in a favorable manner, while "Poor" denotes a double container from which the liquid content could not be dispensed unless the outer layer body was pressed firmly, or no liquid content was dispensed at all even if the outer layer body was pressed firmly.

Outer layer body restoration time was determined by measuring the time it took for the outer layer body to fully restore its original shape after being released from the pressure. The measurement results listed in Table 1 are the average of multiple double containers for each type of outer layer body, measured for the time it took for the outer layer body to fully restore its original shape. When the average restoration time was less than six seconds (6 s), it was considered no problem in practical use.

Of these, one double container (Comparative Example 1), for which the sum of the minimum cross-sectional area of the ambient air introducing passages was determined to be less than 0.11 $mm^2$, proved problematic in practical use because it would take much time for the outer layer body to restore its original shape. Additionally, double containers (Comparative Examples 2, 3), for which the sum of the minimum cross-sectional area of the ambient air introducing passages was determined to be more than 0.19 $mm^2$, proved problematic in liquid content dispensing performance in terms of the outer layer body needed to be pressed firmly and the outer layer body needed much time to restore its original shape. In contrast, those double containers (Conforming Examples 1 to 6), for which the sum of the minimum cross-sectional area of the ambient air introducing passages was determined to be in the range of 0.11 $mm^2$ to 0.19 $mm^2$, produced satisfactory results. In particular, those double containers (Conforming Examples 3 to 6) whose numerical range as specified above is from 0.14 $mm^2$ to 0.19 $mm^2$ are preferred because of less outer layer body restoration time; of these more preferred are the double containers (Conforming Examples 4, 5) whose numerical range is from 0.16 $mm^2$ to 0.18 $mm^2$ because of even less outer layer body restoration time.

Example 2

Furthermore, double containers that are the same in structure as, but different in volume from the double containers depicted in FIGS. 11 and 12, were studied for their outer layer body restoration time. Table 2 lists the results, including the volume of each double container used in the study. In each case, the sum of the cross-sectional area of two communication grooves 336*a* was 0.14 $mm^2$.

[Table 2]

TABLE 2

| | Volume of Double Container [ml] | Outer Layer Body Restoration Time (ave.) [s] |
|---|---|---|
| Conforming Example 7 | 100 | 5.3 |
| Conforming Example 8 | 150 | 3.2 |
| Conforming Example 9 | 200 | 4.2 |
| Conforming Example 10 | 300 | 3.0 |

It can be seen from the results listed in Table 2 that the double containers according to the disclosure have no problem in practical use in terms of the time it takes for the outer layer body to fully restore its original shape, even if they have a different volume.

In the fourth embodiment, the location where portions having the minimum cross-sectional area in the ambient air introducing passages are provided is not limited to the periphery of the inside plug, and may be anywhere between the ambient air introducing hole and the through hole as deemed appropriate.

The double container according to the disclosure is not limited to the first to fourth embodiments described above, and various changes may be made without departing from the scope of the disclosure as defined in the claims. For example, the double container may be configured with any combination of features specific to the first to third embodiments and to the first to fourth embodiments, such as by setting the minimum cross-sectional area of the throttle passage in the first to third embodiments within the range of 0.11 $mm^2$ to 0.19 $mm^2$.

REFERENCE SIGNS LIST

| | | | |
|---|---|---|---|
| 1 | Double container | 2 | Container body |
| 3 | Dispensing cap | 4 | Inner layer body |
| 4a | Container portion | 4b | Upper opening |
| 5 | Outer layer body | 5a | Mouth portion |
| 5b | Trunk portion | 5c | Male screw portion |
| 5d | Fitting portion | 6 | Aperture |
| 7 | Cylindrical wall | 7a | Female screw portion |
| 8 | Top wall | 8a | Stepped portion |
| 8b | Annular groove | 9 | Dispensing spout |
| 10 | Over cap | 10a | Plug body |
| 11 | Hinge | 12 | Inside plug |
| 13 | Main body portion | 13a | Annular groove |
| 14 | Inner circumferential wall | 15 | Fitting tubular portion |
| 16 | Dispensing passage | 21 | Valve unit |
| 21A | Check valve | 21a | Partition wall |
| 21b | Valve portion | 21c | Connecting piece |
| 22 | Dispensing region | 23 | Tubular portion |
| 23a | Diameter-decreasing portion | 24 | Ball |
| 31 | Ambient air introducing hole | 32 | First vent region |
| 33 | Second vent region | 34 | Groove portion |
| 35 | Throttle passage | | |
| 35a | Diameter-increasing hole | 35b | Small hole |
| 36 | Helical passage | 37 | Communication groove |
| 41 | Longitudinal groove | 42 | Cut-out portion |
| 43, 44: | Longitudinal groove | 45 | Throttle groove |
| 101 | Double container | 110 | Outer layer body |
| 111 | Mouth portion | 112 | Trunk portion |
| 113 | Male screw portion | 114 | Aperture |
| 115 | Groove portion | 120 | Inner layer body |
| 121 | Upper opening | 130 | Inside plug |
| 131 | Main body portion | 132 | Tubular portion |
| 133 | Stepped portion | 134 | Dispensing passage |
| 135 | Fitting wall | | |

-continued

REFERENCE SIGNS LIST

| | | | |
|---|---|---|---|
| 136 | Inner circumferential wall | | |
| 136a | Narrow groove (throttle passage) | | |
| 136b | Narrow groove (throttle passage) | | |
| 137 | Fitting tubular portion | 140 | Content check valve |
| 141 | Partition wall | 142 | Connecting piece |
| 143 | Valve portion | 150 | Dispensing cap |
| 151 | Cylindrical wall | 151a | Helical convex portion |
| 152 | Female screw portion | 153 | Top wall |
| 154 | Dispensing spout | 155 | Upper fitting wall |
| 156 | Ambient air introducing hole | 157 | Projection |
| 160 | Over cap | 161 | Hinge |
| 162 | Upper wall | | |
| 163 | Cap-body circumferential wall | | |
| 164 | Plug body | 201 | Double container |
| 202 | Container body | 203 | Dispensing cap |
| 204 | Inner layer body | 204a | Container portion |
| 204b | Upper opening | 205 | Outer layer body |
| 205a | Mouth portion | 205b | Trunk portion |
| 205c | Male screw portion | 205d | Fitting portion |
| 206 | Aperture | 207 | Cylindrical wall |
| 207a | Female screw portion | 208 | Top wall |
| 208a | Stepped portion | 208b | Annular groove |
| 209 | Dispensing spout | 210 | Over cap |
| 210a | Plug body | 211 | Hinge |
| 212 | Inside plug | 213 | Main body portion |
| 213a | Annular groove | | |
| 214 | Inner circumferential wall | 215 | Fitting tubular portion |
| 216 | Dispensing passage | 221 | Valve unit |
| 221A | Check valve | 221a | Partition wall |
| 221b | Valve body | 221c | Connecting piece |
| 222 | Dispensing region | 223 | Tubular portion |
| 223a | Diameter-decreasing portion | 224 | Ball |
| 231 | Vent region | 232 | Groove portion |
| 233 | Throttle passage | | |
| 233a | Large diameter-increasing hole | | |
| 233b | Small diameter-increasing hole | | |
| 301 | Double container | 310 | Inner layer body |
| 320 | Outer layer body | 321 | Trunk portion |
| 322 | Mouth portion | 322a | Upper opening |
| 322b | Male screw portion | 323 | Aperture |
| 324 | Groove portion | 330 | Inside plug |
| 331 | Main body portion | 332 | Tubular portion |
| 332a | Diameter-decreasing portion | 333 | Stepped portion |
| 334 | Dispensing passage | 335 | Fitting wall |
| 336 | Inner circumferential wall | | |
| 336a | Communication groove (groove portion) | | |
| 336b | Transverse groove | 337 | Fitting tubular portion |
| 340 | Check valve | 341 | Partition wall |
| 342 | Connecting piece | 343 | Valve body |
| 350 | Ball | 360 | Dispensing cap |
| 361 | Cylindrical wall | 362 | Female screw portion |
| 363 | Top wall | 364 | Dispensing spout |
| 365 | Upper fitting wall | | |
| 366 | Ambient air introducing hole | 370 | Over cap |
| 371 | Hinge | 372 | Upper wall |
| 373 | Cap-body circumferential wall | | |
| 374 | Plug body | B | Spherical body |
| N | Inner space | S | Container portion |
| T1 | Vent passage | T2 | Connection passage |
| T3 | Ambient air introducing passage | | |

The invention claimed is:

1. A double container, comprising:

an inner layer body provided with an upper opening contiguous with a content container portion;

an outer layer body accommodating the inner layer body and including a mouth portion provided with an aperture, through which aperture ambient air is introduced between the inner layer body and the outer layer body; and a dispensing cap provided with a content dispensing spout and fitted to the mouth portion of the outer layer body, wherein the double container further comprises:

an inside plug provided with a dispensing passage and fitted to the upper opening, the dispensing passage placing the container portion in communication with the dispensing spout; and a check valve configured to open and close the dispensing passage, a vent region is provided inside the dispensing cap, and a throttle passage is provided in a passage extending from an ambient air introducing hole through the vent region to the aperture, the ambient air introducing hole placing the vent region in communication with the outside, wherein an air check valve for holding ambient air introduced between the inner layer body and the outer layer body is not provided in the passage.

2. The double container of claim 1, wherein the ambient air introducing hole is provided in the dispensing cap, the dispensing cap includes a cylindrical wall covering the outer circumference of the mouth portion, and the cylindrical wall includes a lower end portion fitted to an outer circumferential surface of the outer layer body to seal a lower end of the vent region, between the dispensing cap and the inside plug, a partition wall is provided to divide the interior of the dispensing cap into the vent region and a dispensing region connecting the dispensing passage and the dispensing spout, and the throttle passage is provided above the upper opening.

3. The double container of claim 2, wherein the throttle passage is provided in the dispensing cap together with the ambient air introducing hole.

4. The double container of claim 2, wherein the throttle passage is provided in the inside plug.

5. The double container of claim 2, wherein the throttle passage is a space between the dispensing cap and the inside plug.

6. The double container of claim 1, wherein the inside plug has the dispensing passage in a ceiling wall covering the upper opening, and includes an inner circumferential wall standing from an edge of the ceiling wall, the dispensing cap includes a cylindrical wall that is engaged with and held by the mouth portion and that forms a vent passage in communication with the aperture between the mouth portion and the inner circumferential wall of the inside plug, and the dispensing spout and the ambient air introducing hole are provided in a top wall connecting to the cylindrical wall, the check valve includes a partition wall that is provided between the dispensing spout and the ambient air introducing hole and that extends between the ceiling wall and the top wall so as to define, with the inner circumferential wall, an inner space connecting to the ambient air introducing hole, the inside plug has a connection passage connecting the inner space and the vent passage between an upper surface of the inner circumferential wall and a lower surface of the top wall, and the throttle passage is provided in at least one of the vent passage and the connection passage.

7. The double container of claim 6, wherein the throttle passage is a narrow groove provided on at least one of an outer circumferential surface of the inner circumferential wall and an inner circumferential surface of the cylindrical wall.

8. The double container of claim 6, wherein the throttle passage is a narrow groove provided on at least one of an upper surface of the inner circumferential wall and a lower surface of the top wall.

9. The double container of claim 6, wherein one of the inner circumferential wall and the cylindrical wall has a helical convex portion protruding toward the other.

10. The double container of claim 6, wherein the dispensing cap has a projection protruding from a lower surface of the top wall between the ambient air introducing hole and the inner circumferential wall.

11. The double container of claim 6, wherein the inside plug has a tubular wall that extends toward the container portion, and a spherical body that is displaceable inside the tubular wall in response to a change in position of the outer layer body.

12. The double container of claim 1, wherein the dispensing cap includes a cylindrical wall covering the outer circumference of the mouth portion, and the cylindrical wall includes a lower end portion fitted to an outer circumferential surface of the outer layer body to define a vent region formed between the cylindrical wall and the mouth portion, and the throttle passage is provided below the upper opening.

13. The double container of claim 12, wherein the throttle passage is formed in a groove-like manner on an inner circumferential surface of the cylindrical wall in a lower end portion thereof.

14. The double container of claim 12, wherein the throttle passage is provided in the cylindrical wall.

15. The double container of claim 1, wherein the check valve has a partition wall to separate the dispensing spout from the ambient air introducing hole to form said vent region inside the dispensing cap, and the sum of the minimum cross-sectional area of each vent region is 0.11 $mm^2$to 0.19 $mm^2$.

16. The double container of claim 15, wherein a groove portion forming part of the vent region and having the minimum cross-sectional area in the vent region is provided on at least one of a cylindrical wall covering an outer circumference of the mouth portion and the periphery of the inside plug.

17. The double container of claim 16, wherein the groove portion is provided on the periphery of the inside plug.

* * * * *